US005395539A

United States Patent [19]

Chandler et al.

[11] Patent Number: 5,395,539

[45] Date of Patent: Mar. 7, 1995

[54] AMIDE CONTAINING FRICTION MODIFIER FOR USE IN POWER TRANSMISSION FLUIDS

[75] Inventors: John E. Chandler, Edison; Antonio Gutierrez, Mercerville; Jack Ryer, East Brunswick, all of N.J.; Yasuhiko Yoneto, Fujisawa, Japan; Richardo A. Bloch, Scotch Plains, N.J.; Raymond F. Watts, Long Valley, N.J.; Robert D. Lundberg, Bridgewater, N.J.

[73] Assignee: Exxon Chemical Patents Inc., Linden, N.J.

[21] Appl. No.: 31,937

[22] Filed: Mar. 15, 1993

Related U.S. Application Data

[63] Continuation of Ser. No. 425,939, Oct. 24, 1989, abandoned, which is a continuation of Ser. No. 261,640, Oct. 24, 1988, abandoned.

[51] Int. Cl.[6] ..... C10M 133/56; C10M 149/12

[52] U.S. Cl. ..... 252/51.5 A; 252/77

[58] Field of Search ..... 252/51.5 A

[56] References Cited

U.S. PATENT DOCUMENTS

| | | | |
|---|---|---|---|
| 2,291,396 | 7/1942 | Lieber | 252/51.5 A |
| 2,435,631 | 2/1948 | Lieber | 252/51.5 A |
| 2,568,876 | 9/1951 | White et al. | 252/51.5 A |
| 2,622,018 | 12/1952 | White et al. | 49/342 |
| 2,622,067 | 12/1952 | White et al. | 252/51.5 A |
| 2,693,468 | 11/1954 | Blair | 252/51.5 A |
| 2,713,583 | 7/1955 | Smith | 252/51.5 A |
| 2,736,658 | 2/1956 | Pfohl et al. | 252/51.5 A |
| 2,750,342 | 6/1956 | Mikeska et al. | 252/51.5 A |
| 2,852,467 | 9/1958 | Hollyday, Jr. | 252/51.5 A |
| 2,960,523 | 11/1960 | O'Brien | 252/49.8 |
| 3,000,916 | 9/1961 | Klass et al. | 252/49.6 |
| 3,110,673 | 11/1963 | Benoit, Jr. | 252/51.5 A |
| 3,169,980 | 2/1965 | Benoit, Jr. | 252/51.5 A |
| 3,251,853 | 5/1966 | Hoke | 252/51.5 A |
| 3,405,064 | 10/1968 | Miller | 252/51.5 A |
| 3,445,441 | 5/1969 | Rushton | 260/89.5 |
| 3,446,738 | 5/1969 | Chao et al. | 252/51.5 A |
| 3,630,902 | 12/1971 | Coupland et al. | 252/51.5 A |
| 3,634,256 | 1/1972 | Bickham | 252/51.5 R |
| 3,806,456 | 4/1974 | Vogel | 252/51.5 A |
| 3,857,791 | 12/1974 | Marcellis et al. | 252/51.5 A |
| 3,933,659 | 1/1976 | Lyle et al. | 252/51.5 A |
| 4,081,387 | 3/1978 | Ripple | 252/46.6 |
| 4,151,173 | 4/1979 | Vogel | 252/51.5 R |
| 4,201,684 | 5/1980 | Malec | 252/47.5 |
| 4,511,480 | 4/1985 | Outlaw et al. | 252/8.555 |
| 4,634,543 | 1/1987 | Okada et al. | 252/78.5 |
| 4,664,826 | 5/1987 | Gutierrez et al. | 252/48.2 |
| 4,702,850 | 10/1987 | Gutierrez et al. | 252/48.2 |
| 4,705,643 | 11/1987 | Nemo | 252/51.5 A |
| 4,760,170 | 7/1988 | Gutierrez et al. | 560/190 |
| 4,776,969 | 10/1988 | Ryer et al. | 252/46.7 |
| 4,857,217 | 8/1989 | Gutierrez et al. | 252/47 |
| 4,863,624 | 9/1989 | Einert et al. | 252/51.5 A |
| 4,956,107 | 9/1990 | Gutierrez et al. | 252/51.5 A |
| 5,064,546 | 11/1991 | Dasai | 252/32.5 |

FOREIGN PATENT DOCUMENTS

| | | |
|---|---|---|
| 0286996 | 10/1988 | European Pat. Off. . |
| 62-164796 | 7/1987 | Japan . |
| 1061494 | 3/1967 | United Kingdom . |
| 1075121 | 7/1967 | United Kingdom . |

*Primary Examiner*—Ellen M. McAvoy
*Attorney, Agent, or Firm*—T. J. Shatynski

[57] ABSTRACT

Friction modifier additives useful in power transmission compositions, particularly automatic transmission fluids, is disclosed. The additive comprises Component-1 alone formed by condensing a polyamine, such as tetraethylene pentamine, with an aliphatic mono acid, such as isostearic acid, or a mixture, and/or salt, of Component-1 and a Component-2 wherein Component-2 is an acid ester formed by reacting a heterodialkanol such as thiobisethanol and a hydrocarbyl substituted dicarboxylic acid or anhydride, such as octadecenyl succinic anhydride.

10 Claims, No Drawings

AMIDE CONTAINING FRICTION MODIFIER FOR USE IN POWER TRANSMISSION FLUIDS

This is a continuation of application Ser. No. 425,939, filed Oct. 24, 1989, now abandoned, which is continuation of U.S. Ser. No. 261,640, filed Oct. 24, 1988, now abandoned.

BACKGROUND OF THE INVENTION

The present invention relates to certain hydrocarbon soluble or dispersible amide reaction products (referred to herein as Component-1), and mixtures, and/or acid amine salts of Component-1 and certain acid/esters (said acid/esters being referred to herein as Component-2), which are useful as friction modifying additives for oleaginous compositions such as lubricating oils, including power transmitting fluids, particularly automatic transmission fluids (ATF), and to the oleaginous compositions in which they are contained.

There are many instances, as is well known, particularly under boundary lubrication conditions where two moving surfaces in contact with each other must be lubricated, or otherwise protected, so as to prevent wear, and to insure continued movement. There are other instances where friction between two rubbing surfaces is sought to be modified but not necessarily minimized. By controlling friction between two surfaces, the energy transferred from one surface to another is also controlled.

For example, specialized properties sought to be imparted to certain lubricating oil compositions adapted for use as an automatic transmission fluid are the friction characteristics of the fluid. These properties distinguish automatic transmission fluids (ATF) from other lubricants, and in fact between types of ATF's as well. Such characteristic qualities have received the most attention by both the transmission manufacturers and fluid producers for many years. This attention stems from the fact that the friction requirements of an ATF are unique and depend on the transmission and clutch design, as well as on the type of clutch plate material used.

As is also well known, frictional characteristics of lubricants can be controlled through the addition of suitable additives with varying degrees of success.

While there are many known additives which may be classified as friction modifying agents, it is also known that many of these additives act in a different physical or chemical manner and often compete with other additives, such as anti-wear additives for the surface of the moving metal parts which are subjected to lubrication. Accordingly, extreme care must be exercised in the selection of these additives to insure compatibility and effectiveness.

Various tests have been designed by transmission manufacturers for measuring ATF friction. The object of these tests is to evaluate the performance of ATF additives against the requirements of particular transmission design and their ability to impart transmission durability and smooth shifting under a variety of road conditions.

One way to evaluate friction modification under simulated transmission operating conditions is in an SAE No. 2 friction apparatus. In this test, a test head containing a test clutch pack and the fluid is fitted to an electric motor with an inertia disc. The motor and flywheel of the friction machine (filled with fluid to be tested) are accelerated to constant speed, the motor is shut off and the flywheel speed is decreased to zero by application of the clutch. The clutch plates are then released, the system is again accelerated to constant speed, and the clutch pack which is immersed in the test fluid is engaged again. This process is repeated many times with each clutch engagement being called a cycle. The number of cycles employed for a given test is determined by the particular test being run.

During the clutch application, friction torque is recorded as a function of time. The friction data obtained are either the torque traces themselves or friction coefficients calculated from the torque traces. The shape of the torque trace desired is set by the transmission manufacturer. One way of characterizing friction performance is to determine the torque: (a) when the flywheel speed is midway between the maximum constant speed selected and zero speed (such torque measurement is referred to herein as $T_D$) and (b) when as the flywheel speed approaches zero rpm (such torque measurement is referred to herein as $T_0$). Such torques can then be used to determine the torque ratio which is expressed as $T_0/T_D$, or alternatively, to determine the torque differential $T_0$-$T_D$. The optimum target values for torque ratio and torque differential are set by the auto manufacturers and can be different for each manufacturer. As the $T_0/T_D$ increasingly exceeds 1.0, a transmission will typically exhibit shorter harsher shifts as it changes gears. On the other hand as $T_0/T_D$ decreases below 1.0, there is an increasingly greater danger of clutch slippage when the transmission changes gears. Similar relationships exist with respect to a $T_0$-$T_D$ target value of 0.

If the torque traces are converted to friction coefficients, the torque ratio can be expressed as $\mu_O/\mu_D$, where $\mu_O$ is the friction coefficient of $T_O$ and $\mu_D$ is the friction coefficient of $T_D$, In addition to constraints placed on the torque ratio, many transmission manufacturers require that the dynamic torque $T_D$ be at least a certain minimum value. This stems from the fact that high dynamic friction produces short efficient lock-ups. This, in turn, minimizes absorption of energy by the fluid and clutch thereby also minimizing fluid temperature.

While many automatic transmission fluids can achieve acceptable torque ratios and meet minimum dynamic torque targets after a minimum number of cycles, it becomes increasingly more difficult to sustain such target values as the number of cycles are increased. The ability of an ATF to sustain such desired friction properties over time is referred to herein as friction stability or durability.

Attempts to improve friction stability by simply adding more friction modifier have not met with success because this tends to reduce overall fluid friction properties, and particularly the breakaway static torque ($T_S$) of the fluid. This parameter, or alternatively, the breakaway static torque ratio ($T_S/T_D$) reflect the relative tendency of engaged parts, such as clutch packs, bands and drums, to slip under load. If this value is too low, the slippage can impair the driveability and safety of the vehicle.

More specifically, breakaway static torque ($T_S$) is determined upon completion of certain predetermined cycles of the dynamic torque evaluation sequence. In the $T_S$ determination after the flywheel has returned to 0 rpm, it is again accelerated to a lower rpm, e.g., 1 rpm without the clutch engaged. At 1 rpm, the clutch is engaged, but not released, and hence does not turn. Upon clutch engagement, the torque applied by the flywheel is measured as a function of time for a brief period as slippage of the flywheel occurs.

Another aspect of friction modification is observed in clutches at low relative sliding clutch speeds. The operation whereby a clutch pack fully engages is often referred to as lock-up. Continuing operation of the clutch at low sliding speeds, or partially locked-up, can cause the clutch plates to grab and release intermittently. This phenomena is referred to as stick-slip and is experienced by the driver as a shudder in the automobile.

A still further aspect of friction modification is the break-in period. Typically, when testing an ATF, one can observe a change in frictional performance with time. This change occurs over a duration often referred to as the break-in period. It is an advantage to employ a friction modifier which does not exhibit a break-in period or which yields a very short break-in period.

Transmission designs have undergone radical changes, thereby necessitating the formulation of ATF additives capable of meeting new and more stringent requirements needed to match such design changes.

No base oil alone can even approach the many special properties required for ATF service. Consequently, it is necessary to employ several chemical additives, each of which is designed to impart or improve a specific property of the fluid. Consequently, it becomes particularly advantageous when one additive can perform more than one function, thereby reducing the number of additives needed to be present in the formulation.

Accordingly, there has been a continuing search for new additives possessed of one or more properties which render them suitable for use in ATF compositions, as well as other oleaginous compositions. There also has been a search for new combinations of additives which not only provide ATF compositions, as well as other oleaginous compositions, with the various specific properties that are required, but which are compatible with each other in the sense that they do not exhibit any substantial tendency to compete with each other, nor to otherwise reduce the effectiveness of the various additives in the compositions. The present invention was developed in response to this search.

U.S. Pat. No. 4,702,850 discloses certain $C_{12}$–$C_{50}$ hydrocarbyl substituted succinate esters of thiobisethanol as friction modifiers in automatic transmission fluids. These additives are included in the scope of the succinate ester Component-2 reactant employed in the present invention.

U.S. Pat. No. 4,664,826 discloses certain metal (e.g., Ca and Mg) ester salts of the above described succinate esters as friction modifiers in an ATF.

U.S. Pat. No. 4,760,170 discloses a solution process for preparing certain oil solubilized metal ester salts of the type described above.

U.S. Pat. No. 4,776,969 discloses certain cyclic phosphate anti-wear additives which may be employed with the above described succinate ester friction modifiers. At Col. 14, lines 60 et seq., additional friction modifiers are disclosed.

U.S. Pat. No. 3,634,256 discloses an automatic transmission fluid containing (1) a friction modifier selected from the group consisting of oxyalkylated aliphatic tertiary amines, 1-hydroxyalkyl-2 alkyl imidazolines (e.g., 1-hydroxyethyl-2-heptacecyl-2-imidazoline) and mixtures thereof, and (2) an oil soluble polyalkenyl substituted succinimide of an alkylene polyamine. Note further Col. 2, Line 49 et seq., wherein further imidazoles are disclosed.

U.S. Pat. No. 2,622,067 discloses the amide containing reaction product of long chain aliphatic monocarboxylic acid and polyalkylene polyamines as an emulsifying agent for stabilizing water-in-oil emulsions.

U.S. Pat. Nos. 2,693,468 and 2,713,583 disclose imidazoline containing materials for use in lubricants.

U.S. Pat. No. 2,736,658 discloses the use of polyamine fatty acid salts and corrosion inhibitors for lube oils.

U.S. Pat. No. 3,857,791 discloses a 2-component mixture comprising a high molecular weight amido-amine acid and high molecular weight hydrocarbyl amine, particularly for 2-cycle engine oils.

U.S. Pat. No. 2,291,396 discloses a class of wax modifiers which are prepared by condensing polyalkylene polyamines with fatty acids, preferably fatty acids having more than 10 carbon atoms. The wax modifiers are disclosed as being useful as a pour depressant for waxy mineral oils when used in amounts of from about 0.1 to about 10%, preferably from 0.5 to 5%. The modifiers are also disclosed as being suitable for use as a dewaxing aid, or as an addition agent to paraffin wax, or other normally hard, brittle wax, to modify the properties thereof.

U.S. Pat. No. 3,000,916 relates to rust inhibiting additives for engine lubricating oils which are prepared by first reacting polymerized linoleic acid with an amine, and then reacting the acid-amine condensate with boric acid. See also U.S. Pat. No. 2,568,876.

U.S. Pat. No. 3,251,853 relates to oil-soluble nitrogen-containing compositions which are useful as additives for lubricating compositions for internal combustion engines, such as two-cycle spark ignition engines which utilize an oil-fuel mixture as a lubricant. The nitrogen-containing compositions are prepared by reacting an amine and a branched chain acid having from about 14 to 20 aliphatic carbon atoms in the principal chain and at least one aliphatically substituted pendant aryl group. A similar disclosure is set forth in U.S. Pat. No. 3,405,064, except that the branched chain acid has a pendant lower acyclic aliphatic group instead of a pendant aryl group, and the nitrogen-containing product is characterized by the presence of amidino linkages.

U.S. Pat. No. 3,110,673 relates to an ashless detergent lubricant composition having pour point depressing properties. The composition contains about 0.1 to 10% of a pour point lowering and dispersing agent additive comprising a polyamide formed by reacting a polyalkylene polyamine with a blend of straight chain fatty acids and branched chain fatty acids. The polyamides are such that they contain from 1 to 3 amine groups in addition to amide groups. See also, U.S. Pat. Nos. 2,852,467, 3,169,980 and 2,435,631.

U.S. Pat. No. 4,634,543 relates to a fluid composition for use in a shock absorber. The fluid composition comprises a lubricating oil, a boron-containing compound and a phosphorus-containing compound such as a phosphate, phosphite or the like. The boron-containing compound may be prepared, for example, by reacting the reaction product of isostearic acid and tetraethylene pentamine with boric acid.

U.S. Pat. No. 4,705,643 discloses an ashless two-stroke cycle additive which is prepared by condensing a fatty acid such as isostearic acid and a polyamine having at least three amine groups such as tetraethylene pentamine. The additive is said to maintain engine cleanliness and is used at a concentration level of about 10% in combination with a lubricating oil. See also, U.S. Pat. No.

2,622,018 for the use of such materials as gasoline additives.

U.S. Pat. No. 2,750,342 discloses a class of synthetic phosphorous- and sulfur-containing compounds which are useful as lubricating oil additives and which are characterized by the general formula:

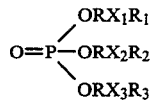

in which R represents a saturated aliphatic $C_2$–$C_3$ hydrocarbon group, $X_1$, $X_2$ and $X_3$ each represent O or S, and $R_1$, $R_2$ and $R_3$ each represent a $C_1$–$C_{18}$ alkyl group or a series of saturated aliphatic hydrocarbon groups interlinked by O or S atoms.

U.S. Pat. No. 2,960,523 discloses phosphoric ester derivatives of hydroxyalkyl vinyl sulfides having the general formula:

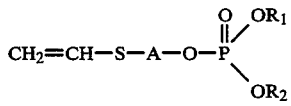

where A is a $C_2$–$C_6$ alkylene group, and $R_1$ and $R_2$ each are $C_1$–$C_4$ alkyl groups. The disclosed ester derivatives can be copolymerizable with various acrylic esters to provide copolymers which have utility as flame-proofing agents for textiles and paper products.

U.S. Pat. No. 3,446,738 discloses an ester base lubricating composition comprising an aromatic amine and an organic thiophosphite or thiophosphonate having the formula:

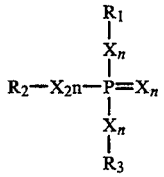

wherein X is O or S, at least one X being S; n is 0 or 1, but at least three n's being 1; and $R_1$, $R_2$ and $R_3$ are alkyl or aromatic groups. The organic thiophosphite or thiophosphonate functions as an anti-oxidant.

U.S. Pat. No. 4,081,387 discloses lubricating compositions comprising a major proportion of lubricating oil and a minor proportion of at least one phosphorous- and sulfur-containing additive of the formula:

$$Y^a—S—Y^b$$

wherein $y^a$ is

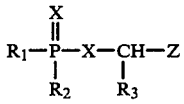

and wherein Z is a saturated or unsaturated hydrocarbyl group; each $R_1$ and $R_2$, independently, is a hydrocarbyl, hydrocarbyloxy or hydrocarbylmercapto group having from 1 to 10 carbon atoms; $R_3$ is hydrogen or a $C_1$–$C_{30}$ hydrocarbyl group; X is S or O; and $Y^b$ is —$R_4$H or —$R_4$—S—$R_5$, wherein $R_4$ is a $C_1$–$C_{30}$ divalent hydrocarbyl group and $R_5$ is H or $y^a$. The disclosed lubricating compositions exhibit increased resistance to oxidative degradation and anti-wear properties.

U.S. Pat. No. 4,511,480 discloses phosphite esters of oxyalkylated thiols as corrosion inhibitors for ferrous metals in deep gas wells. The disclosed esters have the formula:

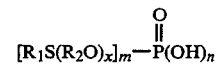

where $R_1$ represents alkyl, cycloalkyl, aryl, aralkyl and heterocyclic; $R_2$ represents alkyl; x is 1–4, m is 1 or 2; n is 1 when m is 2 and n is 2 when m is 1.

U.S. Pat. No. 3,933,659 discloses lubricating oil composition which comprise a major amount of an oil of lubricating viscosity, and an effective amount of each of the following: (1) an alkenyl succinimide, (2) a Group II metal salt of a dihydrocarbyl dithiophosphoric acid, (3) a compound selected from the group consisting of (a) fatty acid esters of dihydric and other polyhydric alcohols, and oil soluble oxyalkylated derivatives thereof, (b) fatty acid amides of low molecular weight amino acids, (c) N-fatty alkyl-N,N diethanoi amines, (d) N-fatty alkyl-N,N-di- (ethoxyethanol) amines, (e) N-fatty alkyl-N,N-di-poly- (ethoxy) ethanol amines, and (f) mixtures thereof, and (4) a basic sulfurized alkaline earth metal alkyl phenate. Such lubricating compositions are useful as functional fluids in systems requiring fluid coupling, hydraulic fluid and/or lubrication of relatively moving parts, particularly as automatic transmission fluids.

U.S. Pat. No. 4,201,684 relates to lubricating oil compositions adapted for use as a crankcase lubricant in internal combustion engines containing a friction reducing amount of a sulfurized fatty acid amide, ester or ester-amide of an oxyalkylated amine.

SUMMARY OF THE INVENTION

The present invention is based in part on the discovery that the amide containing product mixture (referred to herein as Component-1), formed by the reaction of polyamine having at least two, preferably at least three amine groups and certain straight chain or branched chain fatty acids, possess friction modifying properties. Component-1 amides are also stable, non-corrosive, compatible with oleaginous compositions, including the dispersants, anti-oxidants, etc. normally formulated therewith, and do not significantly adversely affect friction stability of automatic transmission fluids. In short, the Component-1 amide product of this invention is considered to be a desirable additive for use in oleaginous compositions, particularly in power transmission fluids, and most particularly in automatic transmission fluids.

Further variations in performance can be achieved by combining Component-1 with certain acid/ester materials (referred to herein as Component-2) as described herein.

More specifically, Component-1 is a very potent friction modifier and exerts its effect with almost no, or a very short, break-in period, e.g., it exerts its maximum friction effect almost immediately. Thus, Component-1 can be employed in very low amounts. If high amounts of Component-1 are employed, e.g., above about 0.7 wt. %, the friction properties of the fluid can be too low for certain transmission manufacturers' standards. However, because of the low amounts of Component-1 typically employed, Component-1 can begin to lose friction potency, e.g., as measured by friction tests which employ a high number of test cycles (e.g., the 18,000 cycle G.M. HEFCAD test). Thus, when a transmission manufacturer's specifications demand both friction stability over extended cycle testing as well as high $T_S$, improvements in friction stability achieved by adding more of Component-1 may be accompanied by a decrease in $T_S$.

Thus, for certain applications, it would be desirable if the friction stability of Component-1 could be further improved.

Component-2 as a friction modifier, is not as potent as Component-1. Consequently, it is employed in higher amounts when used alone relative to Component-1. Moreover, Component-2 possesses better friction stability (in the absence of Zn) than Component-1 alone, but because of its waxy nature and relative high use concentration, it can exhibit poor low temperature viscosity properties measured as the Brookfield viscosity of an ATF fluid. This difficulty can be minimized by reducing the amount employed in an ATF, but then friction performance can suffer. Lastly, Component-2 alone has a long break-in period, e.g., up to about 5,000 cycles on an SAE No. 2 friction machine test.

It has been found that by employing an admixture of Component-1 and Component-2 (either in unreacted or reacted form) in a power transmission fluid, one obtains a compatible system which exhibits almost no break-in period, and possesses good friction stability throughout the entire testing regime as well as good low temperature properties. Thus, one obtains the benefits of each component alone without the potential disadvantages of each alone.

Moreover, by controlling the Component-1: Component-2 weight ratio in the formulation, it is possible to modify the friction properties, at different energy levels or clutch sliding speeds, in accordance with the different requirements of each auto manufacturer.

In one aspect of the present invention, a mixed reaction product, Component-1, which is substantially free of imidazole, is prepared by reacting (1) polyamine and (2) fatty acid. The polyamine is characterized by the presence in its structure of from about 2 to about 60 total carbon atoms and from 2 to about 15, preferably 3 to about 15 nitrogen atoms, with at least one of the nitrogen atoms being present in the form of a primary amine group and at least one, preferably at least two, of the remaining nitrogen atoms being present in the form of primary or secondary amine groups.

The fatty acid is characterized by the formula:

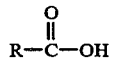

I where R is a straight or branched chain, saturated or unsaturated, aliphatic hydrocarbyl radical containing from about 9 to about 29 carbon atoms, preferably about 11 to about 23 carbon atoms.

In another aspect of the invention, the above mixed reaction product is employed as a friction modifying additive in an oleaginous composition. The mixed reaction product, when used in combination with an ashless dispersant, and preferably with other conventional additives such as a seal swellant, an anti-oxidant, a viscosity index improver and the like, is particularly suited to meeting the stringent ATF requirements from the standpoint of the proper balance of anti-wear, static and dynamic friction coefficients, friction modification and stability, dispersancy, sludge inhibition, anti-oxidation and corrosion resistance properties.

In a still further embodiment of the present invention, there is provided a lubricating oil composition concentrate adaptable for use as an automatic transmission fluid comprising the above-described mixed reaction product, preferably in combination with at least a dispersant.

In another embodiment of the present invention, there is provided a lubricating oil composition concentrate adaptable for use as a power transmitting fluid which comprises a lubricating oil having dissolved or dispersed therein a friction modifying amount of the above-described Component-1 product together with an ashless dispersant, and preferably together with at least one further component selected from seal swellants, anti-oxidants, anti-wear agents, viscosity index improvers and/or agents which possess multifunctional properties including those of anti-wear, friction durability and oxidation inhibition.

In another embodiment of the present invention there is provided a process for improving the friction modification of a lubricating oil composition which is adapted for use as a power transmitting fluid which comprises adding to the lubricating oil composition the Component-1 reaction product described above, in addition to an ashless dispersant.

In still other aspects of the present invention, there is provided a composition formed from the admixture and/or reaction of at least one Component-1 amine with at least one Component-2 acid wherein:

A. Component-1 is at least one reaction product derived from reacting:

(i) amine having from about 2 to about 60 total carbon atoms, at least 3 and up to about 15 nitrogen atoms, with at least one of said nitrogen atoms being present in the form of a primary amine group, and at least two of the remaining nitrogen atoms being present as primary or secondary amine groups, and (ii) aliphatic mono acid having from about 10 to about 30 carbon atoms; said reaction being conducted in a manner and under conditions sufficient to (a) react at least one amine group of reactant A-i amine with the acid group of reactant A-ii acid to form an amide and preferably (b) provide the resulting Component-1 reaction product with at least one reactive primary or secondary amine group; and B. Component-2 is the reaction product derived from reacting:

(i) alcohol represented by the structural formula:

(XXIII)

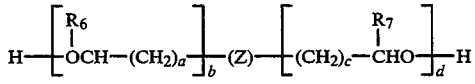

wherein $R_6$ and $R_7$ each independently can represent hydrogen or $C_1$ to $C_6$ alkyl; (a), (b), (c), and (d) each independently represent a number which can vary from 1 to about 3; and Z represents a linking group selected from —S—, —S—S—, O, and $>NR_8$ wherein $R_8$ can represent hydrogen, $C_1$ to about $C_4$ alkyl, or $C_1$ to about $C_4$ monohydroxy substituted alkyl; and (ii) from about 1 to about 2 moles per mole of alcohol of an acid or anhydride represented by the respective structural formulas:

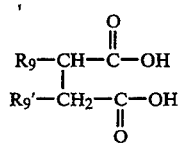

(XXIV)

and

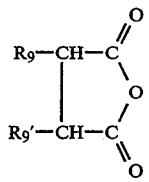

(XXV)

wherein $R_9'$ is hydrogen or $C_1$ to $C_6$ aliphatic hydrocarbyl, $R_9$ is an aliphatic hydrocarbon group containing from about 12 to about 50 carbons.

When said Components-1 and -2 are intended to be reacted, the Component-2 forming reaction is conducted in a manner and under conditions sufficient to (a) react at least one hydroxy group of reactant B-i with at least one carboxyl group of reactant B-ii to form an ester and, (b) provide the resulting Component-2 reaction product with at least one reactive carboxyl group. Components -1 and -2, when reacted, are subjected to conditions sufficient to form the acid/amine salt thereof.

In another aspect of the present invention, there is provided a lubricating oil composition adaptable for use as a power transmitting fluid which comprises lubricating oil and a friction modifying amount of the above-described Component-1 and Component-2-containing composition.

In a still further aspect of the present invention, there is provided a power transmitting fluid such as automatic transmission fluid which comprises lubricating oil and a friction modifying amount of the above described Component-1 and Component-2 containing composition.

In still another aspect of the present invention there is provided a process for improving the friction modification of a lubricating oil adapted for use as a power transmitting fluid which comprises employing the above described Component-1 and Component-2 containing composition as the friction modifier.

DESCRIPTION OF PREFERRED EMBODIMENTS

The present invention is directed to three distinct embodiments.

In the first embodiment, certain amide containing materials are identified which can be used alone as friction modifiers. For convenience, such amides are referred to herein collectively as Component-1. In a preferred aspect of this embodiment, Component-1 is substantially free of imidazole and also contains at least one acid neutralizable amine group to permit reaction and salt formation with a Component-2 defined further hereinafter in connection with embodiments 2 and 3. When Component-1 contains such an acid neutralizable amine group, it is sometimes referred to herein as Component-1A. Component-1A may contain imidazole structures.

In the second embodiment, at least one Component-1 is employed in admixture with at least one co-friction modifier referred to herein as Component-2. More specifically, Component-2 contains at least one ester group and at least one acid or anhydride group.

In the third embodiment, at least one Component-1A is pre-reacted with at lease one Component-2 to form the corresponding acid/amine salt which salt is employed as the friction modifier. Mixtures of the compositions of embodiments -2 and -3 are also included.

More specifically, Component-1 of the present invention comprises a mixture of compounds, formed by reacting in admixture, the following two components namely: (A-i) at least one polyamine and (A-ii) at least one aliphatic mono acid sometimes also referred to herein as a fatty acid.

Component-2 of the present invention comprises the ester containing reaction product of (i) at least one alkanol and (ii) at least one hydrocarbyl substituted dicarboxylic acid material.

A. Component-1

(i) The Polyamine

The polyamine reactant contains at least 2, and typically from about 2 to about 60, preferably about 2 to about 40 (e.g. 3 to about 20), total carbon atoms and at least 2, preferably at least 3, typically from about 2 to about 15 (e.g., 3 to about 15), preferably 3 to about about 12, and most preferably about 3 to about 9 nitrogen atoms in the molecule, with at least one of the nitrogen atoms being present in the form of a primary amine group and at least one, preferably at least two of the remaining nitrogen atoms being present in the form of primary or secondary amine groups. For embodiment-1 only, Component-1 is substantially free of imidazole structures.

The following amine description is subject to the above constraints regarding carbon and nitrogen atom content, and the variable groups for the following formulas are to be selected in conformance with such constraints.

The useful amines, which are preferably polyalkylene polyamines, may be hydrocarbyl amines or may be hydrocarbyl amines including other groups, e.g., hydroxy groups, alkoxy groups, amide groups, nitriles, imidazoline groups, and the like. Hydroxyl amines with 1 to 6 hydroxy groups, preferably 1 to 3 hydroxy groups are particularly useful. Preferred amines are aliphatic saturated amines, including those of the general formulas:

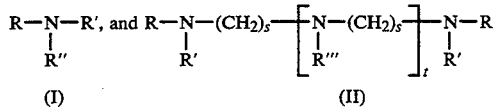

(I) (II)

wherein R, R', R'' and R''' are independently selected from the group consisting of hydrogen; $C_1$ to $C_{25}$ straight or branched chain alkyl radicals; $C_1$to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

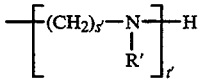

(III)

wherein R′ is as defined above, and wherein s and s′ can be the same or a different number of from 2 to 6, preferably 2 to 4; and t and t′ can be the same or different and are integers of from 0 to 10, preferably 2 to 7, and most preferably about 3 to 7, subject to the provisos that: t is at least 1, the sum of t and t′ is not greater than about 15, there are a total of at least. 2, preferably at least 3, e.g., about 3 to 15, nitrogen atoms in the compound, at least one of the nitrogen atoms is present in the form of a primary amine group and at least one, preferably at least two of the remaining nitrogen atoms are present as primary or secondary amine groups. The most preferred amine compounds of the above formulas are represented by formula II and contain at least two primary amine groups and at least one, and preferably at least three, secondary amine groups.

Non-limiting examples of suitable amine compounds include: polyethylene amines such as diethylene triamine; triethylene tetramine; tetraethylene pentamine; polypropylene amines such as di-(1,2-propylene)triamine; di-(1,3- propylene) triamine; and mixtures thereof.

Other useful amine compounds include: alicyclic and heterocyclic polyamines.

As used herein, the terminology "heterocyclic polyamine" is intended to describe those heterocyclic amines containing the requisite number of nitrogen atoms and the requisite number of primary and secondary nitrogens as described above with at least one nitrogen being present as a heteroatom in a heterocyclic ring. Thus, as long as sufficient primary and secondary nitrogens are present in the heterocyclic polyamine compound overall, the hetero-N atom in the ring can be a tertiary amino nitrogen, that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 50. Heterocyclic amines can contain hetero atoms other than nitrogen, especially oxygen and sulfur. Obviously they can contain more than one nitrogen hetero atom. The 5- and 6-membered heterocyclic rings are preferred.

Among the suitable heterocyclic polyamines are those which contain within their structure the following ring structures: aziridine, azetidine, azolidine, pyridine, pyrrole, indole, piperidine, imidazole, piperazine, isoindole, purine, morpholine, thiomorpholine, azepine, azocine, azonine, azecine and mixtures of two or more of the same. Preferred heterocyclic amines are those which contian saturated 5- and 6-membered heterocyclic amines containing only nitrogen, oxygen and/or sulfur in the hetero ring, especially the piperidine, piperazines, thiomorpholines, morpholines, pyrrolidines, and the like. Mono- and poly-: aminoalkyl-substituted piperidines, aminoalkyl-substituted piperazines, aminoalkyl-substituted morpholines, and aminoalkyl-substituted pyrrolidines, are especially preferred. Usually, the aminoalkyl substituents are substituted on a nitrogen atom forming part of the hetero ring. Specific examples of such heterocyclic amines include N-amino-propylmorpholine, N-aminoethylpiperazine, and N,N′diaminoethylpiperazine. For embodiment-1, imidazoles are not employed.

The most preferred heterocyclic polyamines can be represented by the general formula (IV):

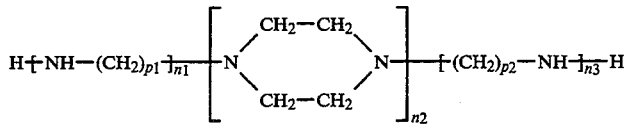

(IV)

wherein $p_1$ and $p_2$ are the same or different and are each integers of from 1 to 4, and $n_1$, $n_2$ and $n_3$ are the same or different and are each integers of from 1 to 3 with the proviso that the sum of $n_1$ and $n_3$ is at least 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamine) compounds averaging about 5 to 7 nitrogen atoms per molecule are available commercially under trade names such as "Polyamine H" "Polyamine 400", "Dow Polyamine E-100", etc.

In addition, many of the simpler, and more commercially available polyamines described above can be linked together to increase the nitrogen content thereby approaching the 15 nitrogen atoms per molecule constraint described above.

This can be achieved through the use of a bifunctional material which contains an ethylenic unsaturation and a terminal amine reactive functional group as described in U.S. Pat. No. 4,857,217, the disclosure of which is herein incorporated by reference. The ethylenic unsaturation at one end of the molecule reacts with a primary or secondary nitrogen of one intermediate polyamine to form an amino group, and the carboxyl or derivative group reacts with another primary or secondary nitrogen of another intermediate polyamine molecule to form an amido group. The resulting compound is therefore referred to herein as an amido-amine which functions as the polyamine reactant A-i used to make Component-1. The amido-amine has a higher nitrogen content per molecule than either of the starting reactant intermediate amines. Thus, the amido-amine can in turn be reacted with the mono acid reactant of formula I to form Component-1. The amido-amine therefore represents simply an alternative amine to those described above.

More specifically, the amido-amine compounds are prepared by reacting at least one polyamine with at least one alpha, beta-unsaturated compound of the formula:

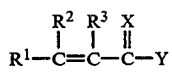

(V)

wherein X is sulfur or oxygen, Y is —$OR^4$, —$SR^4$, or —$NR^4(R^5)$, and $R^1$, $R^2$, $R^3$, $R^4$ and $R^5$ are the same or different and are hydrogen or substituted or unsubstituted hydrocarbyl.

When $R^1$, $R^2$, $R^3$, $R^4$and $R^5$ are hydrocarbyl, these groups can comprise alkyl, cycloalkyl, aryl, alkaryl, aralkyl or heterocyclic, which can be substituted with groups which are substantially inert to any component of the reaction mixture under conditions selected for preparation of the amido-amine. Such substituent groups include hydroxy, halide (e.g., Cl, Fl, I, Br), —SH and alkylthio. When one or more of $R^1$ through $R^5$ are alkyl, such alkyl group can be straight or branched chain, and will generally contain from 1 to 20, more usually from 1 to 10, and preferably from 1 to 4, carbon atoms. Illustrative of such alkyl groups are methyl, ethyl, propyl, butyl, pentyl, hexyl, heptyl, octyl, nonyl, decyl, dodecyl, tridecyl, hexadecyl, octadecyl and the like. When one or more of $R^1$ through $R^5$ are aryl, the aryl group will generally contain from 6 to 10 carbon atoms (e.g., phenyl, naphthyl).

When one or more of $R^1$ through $R^5$ are alkaryl, the alkaryl group will generally contain from about 7 to 20 carbon atoms, and preferably from 7 to 12 carbon atoms. Illustrative of such alkaryl groups are tolyl, m-ethyl-phenyl, o-ethyltolyl, and m-hexyltolyl. When one or more of $R^1$ through $R^5$ are aralkyl, the aryl component generally consists of phenyl or ($C_1$ to $C_6$) alkyl-substituted phenol and the alkyl component generally contains from 1 to 12 carbon atoms, and preferably from 1 to 6 carbon atoms. Examples of such aralkyl groups are benzyl, o-ethylbenzyl, and 4-isobutylbenzyl. When one or more of $R^1$ and $R^5$ are cyclalkyl, the cycloalkyl group will generally contain 3 to 12 carbon atoms, and preferably from 3 to 6 carbon atoms. Illustrative of such cycloalkyl groups are cyclopropyl, cyclobutyl, cyclohexyl, cyclooctyl, and cyclododecyl. When one or more of $R^1$ through $R^5$ are heterocyclic, the heterocyclic group generally consists of a compound having at least one ring of 6 to 12 members in which on one more ring carbon atoms is replaced by oxygen or nitrogen. Examples of such heterocyclic groups are furyl, pyranyl, pyridyl, piperidyl, dioxanyl, tetrahydrofuryl, pyrazinyl and 1,4-oxazinyl.

The alpha, beta-ethylenically unsaturated carboxylate compounds employed herein have the following formula:

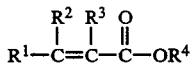

(VI)

wherein $R^1$, $R^2$, $R^3$, and $R^4$ are the same or different and are hydrogen or substituted or unsubstituted hydrocarbyl as defined above. Examples of such alpha, beta-ethylenically unsaturated carboxylate compounds of formula VI are acrylic acid, methacrylic acid, the methyl, ethyl, isopropyl, n-butyl, and isobutyl esters of acrylic and methacrylic acids, 2-butenoic acid, 2-hexenoic acid, 2-decenoic acid, 3-methyl-2-heptenoic acid, 3-methyl-2-butenoic acid, 3-phenyl-2-butenoic acid, 3-cyclohexyl-2-butenoic acid, 2-methyl-2-butenoic acid, 2-propyl-2-propenoic acid, 2-isopropyl-2-methyl-2-pentenoic acid, 2-propenoic acid, methyl 2-propenoate, methyl 2-methyl 2-propenoate, methyl 2-butenoate, ethyl 2-hexenoate, isopropyl 2-decenoate, phenyl 2-pentenoate, tertiary butyl 2-propenoate, octadecyl 2-propenoate, dodecyl 2-decenoate, cyclopropyl 2,3-dimethyl-2-butenoate, methyl 3-phenyl-2-propenoate, and the like.

The alpha, beta-ethylenically unsaturated carboxylate thioester compounds employed herein have the following formula:

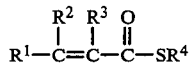

(VII)

wherein $R^1$, $R^2$, $R^3$, and $R^4$ are the same or different and are hydrogen or substituted or unsubstituted hydrocarbyl as defined above. Examples of such alpha, beta-ethylenically unsaturated carboxylate thioesters of formula VII are methylmercapto 2-butenoate, ethylmercapto 2-hexenoate, isopropylmercapto 2-decenoate, phenylmercapto 2-pentenoate, tertiary butylmercapto 2-propenoate, octadecylmercapto 2-propenoate, dodecylmercapto 2-decenoate, cyclopropylmercapto 2,3-dimethyl-2-butenoate, methyl-mercapto 3-phenyl-2-propenoate, methylmercapto 2-propenoate, methylmercapto 2-methyl-2-propenoate, and the like.

The alpha, beta ethylenically unsaturated carboxyamide compounds employed herein have the following formula:

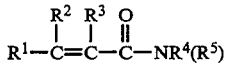

(VIII)

wherein $R^1$, $R^2$, $R^3$, $R^4$ and $R^5$ are the same or different and are hydrogen or substituted or unsubstituted hydrocarbyl as defined above. Examples of alpha, beta-ethylenically unsaturated carboxyamides of formula VIII are 2-butenamide, 2-hexenamide, 2-decenamide, 3-methyl-2- heptenamide, 3-methyl-2- butenamide, 3-phenyl-2-propenamide, 3-cyclohexyl-2-butenamide, 2,methyl-2-butenamide, 2-propyl- 2-propenamide, 2-isopropyl-2-hexenamide, 2,3-dimethyl-2- butenamide, 3-cyclohexyl-2-methyl-2- pentenamide, N-methyl 2-butenamide, N,N-diethyl 2-hexenamide, N-isopropyl 2-decenamide,N-phenyl 2-pentenamide, N-tertiary butyl 2-propenamide, N-octadecyl 2-propenamide, N—N-didodecyl 2-decenamide, N-cyclopropyl 2,3-dimethyl-2-butenamide, N-methyl 3-phenyl-2-propenamide, 2-propenamide, 2-methyl-2-propenamide, 2-ethyl-2-2-propenamide and the like.

The alpha, beta-ethylenically unsaturated thiocarboxylate compounds employed herein have the following formula:

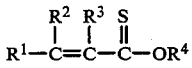

(IX)

wherein $R^1$, $R^2$, $R^3$, $R^4$ and $R^5$ are the same or different and are hydrogen or substituted or unsubstituted hydrocarbyl as defined above. Examples of alpha, beta-ethylenically unsaturated thiocarboxylate compounds of formula IX are 2-butenthioic acid, 2-hexenthioic acid, 2-decenthioic acid, 3-methyl-2-heptenthioic acid, 3-methyl-2-butenthioic acid, 3-phenyl-2-propenthioic acid, 3-cyclohexyl-2-butenthioic acid, 2-methyl-2-butenthioic acid, 2-propyl-2-propenthioic acid, 2-isopropyl-2-hexenthioic acid, 2,3-dimethyl-2-butenthioic acid, 3-cyclohexyl-2-methyl-2-pententhioic acid, 2-propenthioic acid, methyl 2-propenthioate, methyl 2-methyl 2-propenthioate, methyl 2-butenthioate, ethyl 2-hexenthioate, isopropyl 2-decenthioate, phenyl 2-pententhioate, tertiary butyl 2-propenthioate, octadecyl 2-propenthioate, dodecyl 2-decenthioate, cyclopropyl 2,3-dimethyl-2-butenthioate, methyl 3-phenyl-2- propenthioate, and the like.

The alpha, beta-ethylenically unsaturated dithioic acid and acid ester compounds employed herein have the following formula:

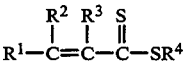

(X)

wherein $R^1$, $R^2$, $R^3$, and $R^4$ are the same or different and are hydrogen or substituted or unsubstituted hydrocarbyl as defined above. Examples of alpha, beta-ethylenically unsaturated dithioic acids and acid esters of formula X are 2-butendithioic acid, 2-hexendithioic acid, 2-decendithioic acid, 3-methyl-2-heptendithioic acid, 3-methyl-2-butendithioic acid, 3-phenyl-2-propendithioic acid, 3-cyclohexyl-2-butendithioic acid, 2-isopropyl-2-hexendithioic acid, 2,3-dimethyl-2-butendithioic acid, 3-cyclohexyl-2-methyl-2-pentendithioic acid, 2-propendithioic acid, methyl 2-propendithioate, methyl 2-methyl 2-propendi-thioate, methyl 2-butendithioate, ethyl 2-hexendi-thioate, isopropyl 2-decendithioate, phenyl 2-pentendithioate, tertiary butyl 2-propendithioate, octadecyl 2-propendithioate, dodecyl 2-decendithioate, cyclopropyl 2,3-dimethyl-2-butendithioate, methyl 3-phenyl-2-propendithioate, and the like.

The alpha, beta-ethylenically unsaturated thiocarboxyamide compounds employed herein have the following formula:

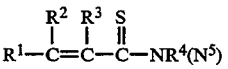

(XI)

wherein $R^1$, $R^2$, $R^3$, $R^4$ and $R^5$ are the same or different and are hydrogen or substituted or unsubstituted hydrocarbyl as defined above. Examples of alpha, beta-ethylenically unsaturated thiocarboxy-amides of formula XI are 2-butenthioamide, 2-hexenthioamide, 2-decenthioamide, 3-methyl-2-heptenthioamide, 3-methyl-2-butenthioamide, 3-phenyl-2-propenthioamide, 3-cyclohexyl-2-butenthioamide, 2-methyl-2-butenthioamide, 2-propyl-2-propenthioamide, 2-isopropyl-2-hexenthioamide, 2,3-dimethyl-2-butenthioamide, 3-cyclohexyl-2-methyl- 2 -pententhioamide, N-methyl 2-butenthioamide, N,N-diethyl 2-hexenthioamide, N-isopropyl 2-decenthioamide, N-phenyl 2-pententhioamide, N-tertiary butyl 2-propenthioamide, N-octadecyl 2-propenthioamide, N—N-didodecyl 2-decenthioamide, N-cyclopropyl 2,3-dimethyl-2-butenthioamide, N-methyl 3-phenyl-2-propenthioamide, 2-propenthioamide, 2-methyl-2-propenthioamide, 2-ethyl-2-propenthioamide and the like.

Preferred compounds for reaction with the intermediate polyamines are lower alkyl esters of acrylic and (lower alkyl) substituted acrylic acid. Illustrative of such preferred compounds are compounds of the formula:

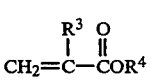

(XII)

where $R^3$ is hydrogen or a $C_1$ to $C_4$ alkyl group, such as methyl, and $R_4$ is hydrogen or a $C_1$ to $C_4$ alkyl group, capable of being removed so as to form an amido group, for example, methyl, ethyl, propyl, isopropyl, butyl, sec-butyl, tert-butyl, aryl, hexyl, etc. In the preferred embodiments these compounds are acrylic and methacrylic esters such as methyl or ethyl acrylate, methyl or ethyl methacrylate. When the selected alpha, beta-unsaturated compound comprises a compound of formula VI wherein X is oxygen, the resulting reaction product with the intermediate polyamine contains at least one amido linkage ($-C(O)N<$) and such materials are herein termed "amido-amines." Similarly, when the selected alpha, beta-unsaturated compound of Formula V comprises a compound wherein X is sulfur, the resulting reaction product with the intermediate polyamine contains thioamide linkage ($-C(S)N<$) and these materials are herein termed "thioamido-amines." For convenience, the following discussion is directed to the preparation and use of amido-amines, although it will be understood that such discussion is also applicable to the thioamido-amines.

The type of amido-amine formed varies with reaction conditions. For example, a more linear amido-amine is formed where substantially equimolar amounts of the unsaturated carboxylate and intermediate polyamine are reacted. The presence of excesses of the ethylenically unsaturated reactant of formula V tends to yield an amido-amine which is more cross-linked than that obtained where substantially equimolar amounts of reactants are employed. Where for economic or other reasons a cross-linked amido-amine using excess amine is desired, generally a molar excess of the ethylenically unsaturated reactant of about at least 10%, such as 10–300%, or greater, for example, 25–200%, is employed. For more efficient cross-linking an excess of carboxylated material should preferably be used since a cleaner reaction ensues. For example, a molar excess of about 1–100% or greater such as 10–50%, of the carboxylated material. Larger excess can be employed if desired.

In summary, without considering other factors, equimolar amounts of reactants tend to produce a more linear amido-amine whereas excess of the formula V reactant tends to yield a more cross-linked amido-amine. It should be noted that the higher the intermediate polyamine (i.e., in greater the number of amino groups on the molecule) the greater the statistical probability of cross-linking since, for example, a tetraalkylenepentamine, such as tetraethylene pentamine

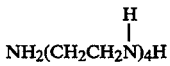

(XIII)

has more labile hydrogens than ethylene diamine.

These amido-amine adducts so formed are characterized by both amido and amino groups. In their simplest embodiments they may be represented by units of the following idealized formula:

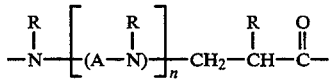

(XIV)

wherein the R's, which may be the same or different, are hydrogen or a substituted group, such as hydrocarbon group, for example, alkyl, alkenyl, aryl, etc., and A is a moiety of the polyamine which, for example, may be aryl, cycloalkyl, alkyl, etc., and n is an integer such as 1–10 or greater.

The above simplified formula represents a linear amido-amine polymer. However, cross-linked polymers may also be formed by employing certain conditions since the polymer has labile hydrogens which can further react with either the unsaturated moiety by adding across the double bond or by amidifying with a carboxylate group.

Preferably, however, the amido-amines are not cross-linked to any substantial degree, and more preferably are substantially linear.

Preferably, the intermediate polyamine reactant contains at least one primary amine (and more preferably from 2 to 4 primary amines) group per molecule, and the polyamine and the unsaturated reactant of formula V are contacted in an amount of from about 3 to 5, equivalents of primary amine in the polyamine reactant per mole of the unsaturated reactant of Formula V.

The reaction between the selected polyamine and acrylate-type compound is carried out at any suitable temperature. Temperatures up to the decomposition points of reactants and products can be employed. In practice, one generally carries out the reaction by heating the reactants below 100° C., such as 80°–90° C., for a suitable period of time, such as a few hours. Where an acrylic-type ester is employed, the progress of the reaction can be judged by the removal of the alcohol in forming the amide. During the early part of the reaction alcohol is removed quite readily below 100° C., in the case of low boiling alcohols such as methanol or ethanol. As the reaction slows, the temperature is raised to push the polymerization to completion and the temperature may be raised to 150° C., toward the end of the reaction. Removal of alcohol is a convenient method of judging the progress and completion of the reaction which is generally continued until no more alcohol is evolved. Based on removal of alcohol, the yields are generally stoichiometric. In more difficult reactions, yield of at least 95% are generally obtained.

Similarly, it will be understood that the reaction of an ethylenically unsaturated carboxylate thioester of Formula VII liberates the corresponding $HSR^4$ compound (e.g., $H_2S$ when $R^4$ is hydrogen) as a by-product, an the reaction of an ethylenically unsaturated carboxyamide of Formula VIII liberates the corresponding $HNR^4(R^5)$ compound (e.g., ammonia when $R^4$ and $R^5$ are each hydrogen as by-product.

The reaction time involved can vary widely depending on a wide variety of factors. For example, there is a relationship between time and temperature. In general, lower temperature demands longer times. Usually, reaction times of from about 2 to 30 hours, such as 5 to 25 hours, and preferably 3 to 10 hours will be employed.

Although one can employ a solvent, the reaction can be run without the use of any solvent. In fact, where a high degree of cross-linking is desired, it is preferably to avoid the use of a solvent and most particularly to avoid a polar solvent such as water. However, taking into consideration the effect of solvent on the reaction, where desired, any suitable solvent can be employed, whether organic or inorganic, polar or non-polar.

As an example of the amido-amine adducts, the reaction of tetraethylene pentamine (TEPA) with methyl methacrylate can be illustrated as follows:

$$2\,H_2N[CH_2CH_2NH]_3CH_2CH_2NH_2 + CH_2{=}CH{-}\overset{\overset{\displaystyle O}{\|}}{C}{-}OCH_3 \longrightarrow$$

$$H_2N[CH_2CH_2NH]_3CH_2CH_2NHCH_2CH_2\overset{\overset{\displaystyle O}{\|}}{C}NHCH_2CH_2[NHCH_2CH_2]_3NH_2 + (CH_3OH)$$

(Eq. 1)

Useful amines for reaction with the mono acid to form Component-1 also include polyoxyalkylene polyamines such as those of the formula:

$$R\left[\text{alkylene}\left(\text{o-alkylene}\right)_n NH_2\right]_a \qquad \text{(XV)}$$

where "n" has a value of about 1 to 40 with the proviso that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in formula XV may be straight or branched chains containing about 2 to 7, and preferably about 2 to 4 carbon atoms.

The polyoxyalkylene polyamines of formula XV above, preferably polyoxyalkylene triamines, may have average molecular weights ranging from about 200 to about 4000, and preferably from about 400 to about 2000. The preferred polyoxyalkylene polyamines include the polyoxypropylene triamines and polyoxyethylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

(ii) The Mono Acid

The aliphatic mono acid reactant A-ii (i.e., fatty acid) used to react any of the above described amine containing compounds to form the Component-1 reactant of the present invention can be characterized by the formula:

$$R{-}\overset{\overset{\displaystyle O}{\|}}{C}{-}OH \qquad \text{(XVI)}$$

where R aliphatic hydrocarbyl, including straight or branched chain, saturated or unsaturated hydrocarbyl group, typically aliphatic having from about 9 to about 29, preferably from about 11 to about 23, and most preferably from about 15 to about 20 carbon atoms. The term "fatty acid" when used is employed for convenience, and it is not intended to signify that it must be derived from natural sources, since it may be manufactured synthetically. The term "hydrocarbyl" is used herein to include substantially hydrocarbyl groups as well as purely hydrocarbyl groups. The description of these groups as being substantially hydrocarbyl means that they contain no non-hydrocarbyl substituents or non-carbon atoms which significantly affect the hydrocarbyl characteristics or properties of such groups relevant to their uses as described herein. For example, in the context of this invention, a purely hydrocarbyl $C_{20}$ alkyl groups and a $C_{20}$ alkyl group substituted with a methoxy substituent are substantially similar in their properties with regard to their use in this invention and would be hydrocarbyl. The fatty acid is a monoacid, preferably having the carboxyl group located terminally.

Representative examples of suitable fatty acids include nonanoic (pelargonic) decanoic (capric); undecanoic; dodecanoic (lauric); tridecanoic; tetradecanoic (myristic); pentadecanoic; hexadecanoic (palmitic); heptadecanoic (margaric); octadecanoic (stearic), (isostearic); nonadecanoic; eicosanoic (arachidic ); docosanoic (behenic); tetracosanoic (lignoceric); hexacosanoic (cerotic); octacosanoic (montanic); triacontanoic (melissic); nonenoic; docenoic; undecenoic; dodecenoic; tridecenoic; pentadecenoic; hexadecenoic; heptadecenoic; octadecenoic (e.g., oleic); cicosenoic; tetracosenoic 12-hydroxystearic; ricinoleic; and mixtures thereof.

The preferred mono acids are stearic acid, isostearic acid, as well as mixtures of stearic and isostearic acids (e.g., a weight ratio of stearic to isostearic of from about 1:0.8 to about 1:9 preferably 1:5.

Non-limiting examples of substituents which do not significantly alter the hydrocarbyl characteristics or properties of the general nature of the hydrocarbyl groups of the mono acid are the following:

Ether groups (especially hydrocarbyloxy such as phenoxy, benzyloxy, methoxy, n-butoxy, etc., and particularly alkoxy groups of up to ten carbon atoms);

Oxo groups (e.g. —O— linkages in the main carbon chain); thio groups (e.g., —S—, —S—S—); hydroxy groups;

Carbohydrocarbyloxy groups (e.g., $-\overset{O}{\overset{\|}{C}}-$O-hydrocarbyl);

Sulfonyl groups (e.g., $-\overset{O}{\overset{\|}{\underset{\underset{O}{\|}}{S}}}-$hydrocarbyl); and -continued Sulfinyl groups (e.g., $-\overset{O}{\overset{\|}{S}}-$hydrocarbyl).

This list is intended to be merely illustrative and not exhaustive, and the omission of a certain class of substituent is not meant to require its exclusion. In general, if such substituents are present, there will not be more than two for each ten carbon atoms in the substantially hydrocarbyl group and preferably not more than one for each ten carbon atoms since this number of substituents usually will not substantially affect the hydrocarbyl characteristics and properties of the group. Nevertheless, the hydrocarbyl groups usually will be free from non-hydrocarbon groups due to economic considerations; that is, they will be purely hydrocarbyl groups consisting of only carbon and hydrogen atoms.

The reaction between the amine reactant A-i and the mono acid reactant A-ii to produce Component-1 reactant of the present invention may be exemplified by the following equation where, for the sake of illustration, the polyamine compound is represented by tetraethylene pentamine and the mono acid is represented by isostearic acid:

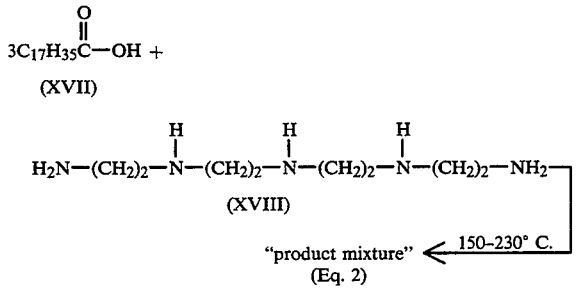

where "product mixture" represents a mixture of products including those of the following formula (XIX) and minor amounts, e.g., less than 1, preferably less than 0.5 mole % imidazoline containing species such as represented by (XX):

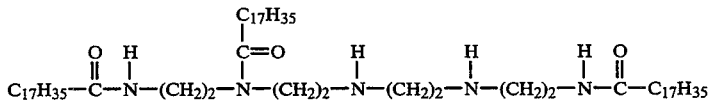

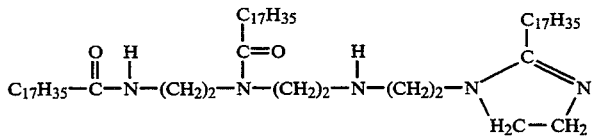

As a result of water formed insitu by the amidation reaction, most, if not all, of the imidazoline of structure (XX) is intentionally hydrolyzed to primary amine in accordance with the following equation:

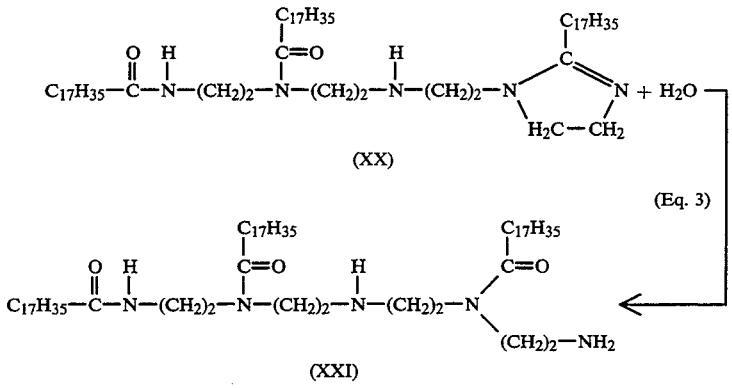

Thus, the Component-1 amines of embodiment-1 of the present invention are substantially free of imidazoline containing structures. By substantially free of imidazoline containing structures is meant less than 5, preferably less than 1, and most preferably less than 0.5 mole % of compounds with imidazoline ring structures.

The reaction of the amine compound and the mono acid is performed, for example, by mixing at least one member from each of the two components and heating the reaction mixture to a temperature and for a time effective to achieve formation of at least one amide group. Hydrolysis of any imidazole structures with water is well known and need not be commented on further.

Thus, while any effective reaction temperatures and times may be employed, it is contemplated that such effective reaction temperatures will range typically from about 100° to about 250° C., (e.g. 130° to about 220° C.) preferably from about 150° to about 230° C. (e.g., 150° to about 200° C.) and most preferably from about 170° to about 220° C. (e.g., 170° to about 200° C.), and said effective reaction times will range typically from about 2 to about 30 (e.g., 3 to about 10), preferably from about 4 to about 6 hours. In general, lower reaction temperatures demand longer times.

The progress of the reaction can be judged by the removal of the water in forming the amide. During the early part of the reaction, water is removed quite readily below 120° C. As the reaction proceeds, the temperature is raised to push the condensation reaction to completion and the temperature may be raised (e.g., to 160° C. or more) toward the end of the reaction. Removal of the water of condensation is a convenient method of judging the progress and completion of the reaction which is generally continued until no more water is evolved. Based on removal of water, the yields are generally stoichiometric. In more difficult reactions, yields of at least about 95% are generally obtained.

Although a solvent such as toluene or xylene can be employed, the reaction can be and preferably is run without the use of any solvent.

The degree to which the reactive nitrogens of the amine reactant are reacted with the mono acid reactant is controlled to (a) impart oil solubility (by the hydrocarbyl group of the mono acid) to the reaction product mixture, and for embodiment 3, (b) avoid consuming all the reactive amine groups in the amine reactant. Oil solubility will depend on the length of the hydrocarbyl group of the mono acid and the number of nitrogens in the amine reactant.

Accordingly, sufficient mono acid is employed to impart oil solubility for embodiments 1 and 2, and for embodiment 3, less than the amount which will amidate all of the reactive amine groups. Thus, for embodiment 3 at least one reactive amine group, i.e., primary or secondary amine group in the resultant Component-1 product mixture is preserved for salt formation.

Generally, the polyamine and mono acid reactants are contacted in an amount such that typically from about 2 to about 10, e.g., about 3 to about 10, molar equivalents of mono acid react per mole of polyamine compound in the reaction mixture. Preferably, the molar ratio of mono acid reactant to polyamine reactant is from about 2.5 to about 7, and most preferably from about 3 to about 5 molar equivalents of acid reacted per mole of polyamine reactant, provided fewer moles of mono acid are employed per total reactive amine equivalents. Thus, in illustrative equation 2, three molar equivalents of isostearic acid are reacted per mole of tetraethylene pentamine (containing 5 reactive amine equivalents), with the condensation taking place at the two primary amine groups and one of the secondary amine groups of the tetraethylene pentamine.

The purity of the reactants can affect the yield of desired products. Accordingly, the greater the reactant purity, the higher will be the yield of desired products.

The above mixed reaction products may be used as Component-1. However, the Component-1 reaction products may also be used in the form of an adduct or reaction product with a boron compound, such as a boric oxide, a boron halide, a metaborate, boric acid, or a mono-, di-, or triorgano borate, such as a mono-, di-, and trialkyl borate provided at least one reactive amine group is preserved for salt formation. Such adducts or derivatives may be illustrated with reference to formula XXII, for example, by the following non-limiting structural formula:

(XXII)

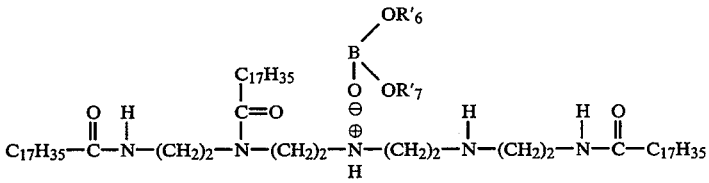

wherein $R'_6$, and $R'_7$, independently, represent either H or a hydrocarbyl, e.g., $C_1$ to about $C_{10}$ alkyl.

Representative examples of alkyl borates which may be used to borate the Component-1 reactant compounds of the present invention include mono-, di-, and tributyl borates, mono-, di-, and trihexyl borates, and the like. The borated adducts may be prepared simply by heating a mixture of the Component-1 material and the boron compound, preferably in the presence of a suitable solvent or solvents, preferably an alcoholic or hydrocarbon solvent. The presence of a solvent is not essential, however, if one is used it may be reactive or non-reactive. Suitable non-reactive solvents include benzene, toluene, xylene and the like. Suitable reactive solvents include isopropanol, butanol, the pentanols and the like. Reaction temperatures suitably may be on the order of about 100° to about 280° C., preferably from about 125° to 175° C. Reaction time is not critical and, depending on the temperature, etc., it may vary from about 1–2 hours up to about 15 hours, e.g., 2 to 6 hours until the desired amount of water is removed. Suitable boration procedures and materials contemplated within the scope of the invention are well known in the art and are described, for example, in U.S. Pat. Nos. 4,382,006, 4,400,284, 4,529,528, 4,594,171, and 4,595,514, the disclosures of which are incorporated herein by reference.

B. Component-2

Component-2 is an ester which has at least one free carboxyl group thereon. More specifically, such esters are typically formed by the reaction of (i) alkanol and (ii) hydrocarbyl substituted dicarboxylic acid material.

(i ) The Alkanol

The alkanol can be represented by the structural formula:

(XXIII)

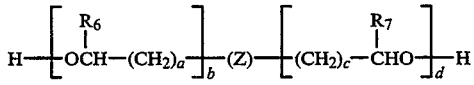

wherein $R_6$ and $R_7$ each independently can represent hydrogen, alkyl (preferably straight chain alkyl), typically $C_1$ to about $C_6$ alkyl, preferably $C_1$ to about $C_3$ alkyl, and most preferably $C_1$ to about $C_2$ alkyl; (a), (b), (c), and (d) each independently represent numbers which can vary from 1 to about 3; and Z is a linking group which is selected from —S—; —S—S—; —O—; and $>NR_8$ wherein $R_8$ can represent hydrogen, a $C_1$ to about $C_{22}$ alkyl group, preferably $C_1$ to about $C_{18}$ (e.g., $C_1$ to $C_4$) alkyl group, or a $C_1$ to about $C_4$ monohydroxy substituted alkyl group, preferably a terminal monohydroxy substituted alkyl group. Preferably $R_6$ and $R_7$ are the same, the numbers represented by (b) and (d) are the same as are the numbers represented by (a) and (c), thereby resulting in bis-alkanol.

When Z is —O—, Formula (XXIII) can represent ethylene glycol and derivatives thereof; when Z is $>NR_8$, and $R_8$ is hydroxy substituted or hydrogen, Formula (XXIII) can represent a diethanoi amine and derivatives thereof; when $R_8$ is a monohydroxy substituted alkyl, such as $$\text{—}(CH_2)_2\text{—}OH,$$

Formula (XXIII) can represent triethanolamine and derivatives thereof.

If b or d are greater than 1, then Formula (XXIII) is meant to express alkoxylated derivatives of the alkanols, such as ethoxylated derivatives. It should be further noted that when diethanolamine or its derivatives as expressed by Formula (XXIII) wherein $R_8$ is hydrogen are reacted with the hydrocarbyl substituted succinic acid or anhydride, the ester product mixture formed thereby can contain an ester-amide moiety, since the NH moiety of diethanolamine is available for reaction with the acid or anhydride moiety. Likewise, when $R_8$ is hydroxy substituted alkyl, the hydroxy substituent of $R_8$ is available for reaction with the acid or anhydride and the reaction product mixture can contain tri-ester moieties.

Notwithstanding the above, while reaction of the $R_8$ substituent with the acid or anhydride is possible, it is not intentionally facilitated. Consequently, the molar amounts of acid or anhydride employed to react with the alkanol are typically selected as though the $R_8$ substituent is inert, e.g., the acid to alcohol molar ratio will remain within the range of from about 1:1 to about 2:1 as described hereinafter in connection with mono and diesters. In such instances, mixtures of ester compounds are typically achieved.

The preferred alkanols are thio-alkanols, wherein in structural Formula (XXIII), Z is —S—, or —S—S— and $R_6$ and $R_7$ are independently hydrogen, ethyl or methyl.

The most preferred alkanols are thio-alkanols wherein in structural Formula (XXIII) (a), (b), (c) and (d) are each 1 or 2, $R_6$ is hydrogen or methyl, and $R_7$ is hydrogen, methyl or ethyl and Z is —S—.

Representative alkanols include 2,2'-thiodiethanoi; 2,2'-dithiodiethanol; 3,3'-thiodipropanol; 3,3'-dithiodipropanol; thio-bis ethoxyethanol; thio-bis isopropoxy isopropanol; oxy-bis ethanol; oxy-bis ethoxyethanol; 2,2'-diethanoi methanamine; 2,2'-diethanol ethanamine; 2,2',2''-triethanolamine; 2,2'-diethanolamine; and mixtures thereof.

(ii) The Hydrocarbyl Substituted Dicarboxylic Acid Material

The hydrocarbyl substituted dicarboxylic acid material which is reacted with the alkanol can be represented by the respective structural formulas:

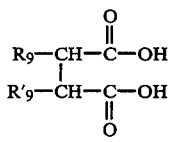

(XXIV)

or

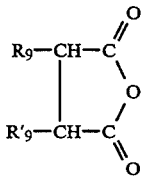

(XXV)

wherein $R'_9$ is $C_1$ to $C_6$ aliphatic hydrocarbyl (e.g., methyl) or hydrogen; and $R_9$ is a hydrocarbyl group, preferably an aliphatic hydrocarbyl group, typically a $C_{12}$ to about $C_{50}$ aliphatic hydrocarbon group (preferably a straight chain aliphatic hydrocarbon group), preferably a $C_{16}$ to about $C_{30}$ aliphatic hydrocarbon group, and most preferably a $C_{18}$ to about $C_{22}$ aliphatic hydrocarbon group. The aliphatic hydrocarbon group can be alkyl including cycloalkyl, preferably straight chain alkyl, alkenyl, preferably straight chain alkenyl, isoalkyl, or isoalkenyl.

Oligomers containing the aforedescribed number of carbon atoms are also suitable as the aliphatic hydrocarbyl group, such as oligomers of $C_2$–$C_5$ monoolefins, such as isobutene.

The $R_9$ hydrocarbyl group is preferably an unsubstituted hydrocarbon group although it may contain substituents as described in connection with R of the mono acid reactant of Component-1, such as chlorine, bromine, sulfur, phosphorous, nitrogen or oxygen which will not affect the utility of the final product. A preferred substituent is sulfur as exemplified by 2-octadecenyl-thiosuccinic anhydride.

The hydrocarbyl substituted dicarboxylic acid material may be prepared by the reaction of a mono unsaturated dicarboxylic acid material with olefins, oligomeric polyolefins, or with chlorinated derivatives thereof using techniques known in the art.

The dicarboxylic acid material is defined herein as (i) monounsaturated $C_4$ to $C_{10}$, preferably $C_4$ to $C_5$, dicarboxylic acid wherein (a) the carboxyl groups are vicinyl, (i.e., located on adjacent carbon atoms) and (b) at least one, preferably both, of said adjacent carbon atoms are part of said mono unsaturation; or with (ii) derivatives of (i) such anhydrides or $C_1$ to $C_5$ alcohol derived mono- or diesters of (i).

Exemplary of such unsaturated dicarboxylic acids, or anhydrides and esters thereof are fumaric acid, itaconic acid, maleic acid, maleic anhydride, chloromaleic acid, chloromaleic anhydride and dimethyl maleate.

Upon reaction with the olefinic hydrocarbon, the monounsaturation of the dicarboxylic acid material becomes saturated. Thus, for example, maleic anhydride becomes a hydrocarbyl-substituted succinic anhydride, which is the preferred hydrocarbyl substituted dicarboxylic acid material.

Moreover, succinic acids are readily produced by hydrolysis of the corresponding anhydride. Especially preferred in preparing the acid/ester compounds of Component-2 are $C_{18}$ to $C_{22}$ alkenyl succinic anhydrides, such as octadecenyl succinic anhydride. Anhydrides are preferred because the reaction is faster and no water is evolved.

As used herein, when the Z group of the alkanol of Formula (XXXIII) is in fact inert, the term "monoester" or "hemiester" refers to product made from equimolar proportions of said alkanol and hydrocarbyl substituted dicarboxylic acid material, that is, one free hydroxyl group remains; while the term "di-ester" refers to those products using a 2:1 molar ratio of acid material to alcohol wherein each hydroxyl group of the alkanol is esterified with a hydrocarbyl-substituted or polyolefin-substituted dicarboxylic acid material.

For use in embodiment 3, the identity of the dicarboxylic acid material is selected to have at least one terminal carboxyl group of the acid material reactant remain, which is used to neutralize the reactive amino group on Component-1. In the case where a diester is formed, 2 free carboxyl groups remain, i.e., one from each.

Formation of the mono- and di-esters proceeds by reacting the appropriate quantities of the hydrocarbyl substituted dicarboxylic acid material and alkanol with or without an inert organic solvent diluent and heating and stirring the mixture at about 50° to 150° C. until esterification of the anhydride is complete. Equimolar quantities of each reactant will typically provide mainly the mono-(or hemi-) ester, and reaction of 2 moles of the hydrocarbyl substituted dicarboxylic acid material per mole of alkanol will typically provide the di-ester material. Also, useful products encompass mixtures of such mono- and di-esters as well as mixtures of metal salt mono-esters, diesters, esteramides, and/or tris-esters depending on the identity of the Z group when constituting $>NR_8$.

The esterification reaction time is typically controlled to be from about 10 to about 30 minutes.

Insofar as yields are concerned, the reaction of an equimolar ratio of alkanol (when Z is inert) and hydrocarbyl substituted dicarboxylic acid material will typically provide a product containing about 80% monoester and about 20% di-ester. The di-ester is produced in somewhat higher yields, about 90% of the product being di-ester and about 10% mono-ester when the mole ratio of the hydrocarbyl substituted dicarboxylic acid material to alkanol is 2:1.

In view of the above, a simplified structural formula of a resulting ester product derived from hydrocarbyl substituted succinic acid reactant and an alkanol wherein Z is inert, can be represented as follows:

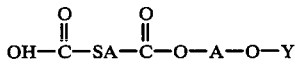

(XXVI)

wherein SA represents the hydrocarbyl substituted succinic acid moiety depicted by Formula (XXIV) above exclusive of the terminal carboxyl groups; (A) represents the alkanol moiety depicted by Formula (XXIII) exclusive of the terminal hydroxyl groups; Y represents hydrogen when the product is hemi-ester, and:

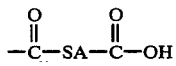

(XXVII)

when the product is a di-ester.

The minimum carbon chain length of the $R_9$ substituent, is affected by the propensity of increasingly longer chains to come out of solution as the fluid composition containing the same is cooled to lower and lower temperatures. The insolubilization of such substituents is undersirable because it results in agglomeration of the same as well as the formation of nucleation sites for wax crystal formation. Thus, the particular maximum substituent chain length selected will be affected by the ultimate end use for which the additive will be employed in terms of temperature regimens to which it will be exposed.

In the preferred embodiment, Component-2 can be represented by the following structural formula:

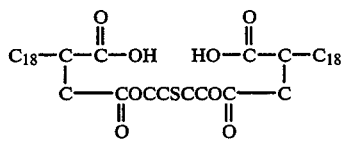

(XXVIII)

As indicated above, Component-1 can be employed in admixture with Component-2 in embodiment 2. Thus, Components-1 and -2 can be separately added to a lubricating oil composition (which may contain other additives) or they can be premixed at room temperature before addition to the lubricating oil composition.

While any weight ratio of Components-1 and -2 can be employed in admixture to enhance friction modification relative to their absence, it is contemplated that such weight ratios will vary typically from about 0.2:1 to about 1.2:1, preferably from about 0.3:1 to about 0.7:1 and most preferably from about 0.4:1 to about 0.7:1 (e.g., 0.6:1 to about 0.7:1). The amounts of the combination of Components-1 and -2 on a weight percent basis is provided hereinafter.

Salt Formation for Embodiment 3

The salt forming reaction of embodiment 3 is conducted by admixing Component-2 with Component-1 and heating the resultant mixture, while stirring, to temperatures of typically from about 20 to about 100, preferably from about 40 to about 90, and most preferably from about 50° to about 80° C., for periods of typically from about 0.8 to about 4.0, preferably from about 0.3 to about 2.0 and most preferably from about 0.75 to about 1 hour. Higher reaction temperatures need shorter reaction times.

Preferably, enough Component-2 is employed to provide a stoichiometric excess of reactive carboxyl groups relative to number of reactive amino (e.g., secondary amino) groups on Component-1 which leads to unreacted Component-2 in the resulting product mixture. Such stoichiometric excess of Component-2 will typically range from about 5 to about 1000, preferably 50 to 800 and most preferably 100 to 600%.

Accordingly, for embodiment 3, while any amount of Component-2 may be reacted with Component-1 which is effective to cause at least some salt formation, it is contemplated that such effective amounts will provide an equivalent ratio of carboxyl groups (on Component-2) to reactive amino groups (on Component-1) of typically from about 1.05:1.0 to about 11:1, preferably from about 1.5:1 to about 9:1, and most preferably from about 2:1 to about 7:1.

For example, in a preferred aspect of embodiment 3 wherein Component-1 is the reaction product of (a) 3 moles of isostearic acid reacted with (b) 1 mole of tetraethylene pentamine (to form what is referred to herein as ISAT or ISA-TEPA), the simplified structural formula for said ISAT being represented by Formula (XIX) above, and Component-2 is represented by Formula (XXVIII) above; preferably about 4 moles of Component-2 is admixed with each mole of Component-1. Since 1 mole of said Component-2 contains 2 equivalents of reactive carboxyl groups, and 1 mole of said Component-1 contains about 2 equivalents of reactive secondary amino groups, the equivalent ratio of Component-2:Component-1 is equal to the molar ratio. Thus, a 4:1 molar ratio represents about 300% stoichiometric excess of Component-2.

Expressed alternatively on a molar basis, effective molar ratios of Component-2:Component-1 will typically range from about 60:1 to about .33:1, preferably from about 10:1 to about 1:1; and most preferably from about 5:1 to about 2:1, subject to the above stoichiometric excess caveat.

It has been found that unreacted Component-1 can have depressive effect on breakaway static torque ($T_S$).

Hence, the use of excess Component-2 during salt formation can be advantageous depending on the particular requirements of a transmission manufacturer, vis-a-vis minimum breakaway static torque requirements.

While the salt forming reaction may be conducted in the absence of a solvent, solvents such as dihexyl phthalate, tridecyl alcohol, alkylated aromatic compounds, diluent oil and mixtures thereof may be employed.

Where no solvent is employed, the resulting salt is a viscous fluid. Consequently, it may be desirable to dilute the final product with any suitable solvent compatible with the ultimate end use.

The friction modifiers of embodiments 1 to 3 of the invention are used by incorporation and dissolution or dispersion into an oleaginous material such as power transmitting fluids, particularly automatic transmission fluids, and to compositions and concentrates used to formulate such fluids.

The present friction modifiers find their primary utility in lubricating oil compositions which employ a base oil in which the friction modifiers are dissolved or dispersed.

Thus, base oils suitable for use in preparing lubricating compositions of the present invention include those conventionally employed as crankcase lubricating oils for spark-ignited and compression-ignited internal combustion engines, such as automobile and truck engines, marine and railroad diesel engines, and the like. However, particularly advantageous results are achieved by employing the friction modifiers of the present invention in base oils conventionally employed in power transmitting fluids such as automatic transmission fluids, tractor fluids, universal tractor fluids and hydraulic fluids, heavy duty hydraulic fluids, power steering fluids and the like.

Thus, the friction modifiers of the present invention may be suitably incorporated into synthetic base oils such as alkyl esters of dicarboxylic acids, polyglycols and alcohols; polyalphaolefins, alkyl benzenes, organic esters of phosphoric acids, polysilicone oil, etc.

Natural base oils include mineral lubricating oils which may vary widely as to their crude source, e.g. whether paraffinic, naphthenic, mixed paraffinic-naphthenic, and the like; as well as to their formation, e.g. distillation range, straight run or cracked, hydrofined, solvent extracted and the like.

More specifically, the natural lubricating oil based stocks which can be used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents such as phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 3.5 to about 9 cst. at 100° C.

Thus the friction modifiers of the present invention can be employed in a lubricating oil composition which comprises lubricating oil, typically in a major amount, and the friction modifiers typically in a minor amount, which is effective to impart enhanced friction modification properties relative to the absence of said additives. Additional conventional additives selected to meet the particular requirements of a selected type of lubricating oil composition can be included as desired.

The friction modifiers of this invention are oil soluble, dissolvable in oil with the aid of a suitable solvent, or stably dispersible in oil. Oil soluble, dissolvable, or stably dispersible, as that terminology is used herein, does not necessarily indicate that the materials are soluble, dissolvable, miscible, or capable of being suspended in oil in all proportions. It does mean, however, that the respective components of the mixture are soluble or stably dispersible in oil to an extent sufficient to exert their intended effect in the environment in which the oil is employed. Moreover, the incorporation of a dispersant, friction modifier and/or other additives may also permit incorporation of higher levels of a particular reaction product salt if desired.

The friction modifier additives of the present invention can be incorporated into the lubricating oil in any convenient way. Thus, they can be added directly to the oil by dispersing, or dissolving the same in the oil at the desired level of concentration typically with the aid of the suitable solvent such as dodecylbenzene or naphthenic base stock. Such blending can occur at elevated temperatures of 60°–100° C.

The lubricating oil base stock for the additives of the present invention typically is adapted to perform a selected function by the incorporation of additives therein to form lubricating oil compositions (i.e., formulations).

As indicated above, one broad class of lubricating oil compositions suitable for use in conjunction with the additives of the present invention are tractor fluids, tractor universal oils, and the like.

The benefits of the additives of the present invention are particularly significant when employed in a lubricating oil adapted for use as an automatic transmission fluid.

Power transmitting fluids, such as automatic transmission fluids, as well as lubricating oils in general, are typically compounded from a number of additives each useful for improving chemical and/or physical properties of the same. The additives are usually sold as a concentrate package in which mineral oil or some other base oil is present. The mineral lubricating oil in automatic transmission fluids typically is refined hydrocarbon oil or a mixture of refined hydrocarbon oils selected according to the viscosity requirements of the particular fluid, but typically would have a viscosity range of 2.5–9, e.g. 3.5–9 cst. at 100° C. Suitable base oils include a wide variety of light hydrocarbon mineral oils, such as naphthenic base oils, paraffin base oils, and mixtures thereof.

Representative additives which can be present in such packages as well as in the final formulation include viscosity index (V.I.) improvers, corrosion inhibitors, oxidation inhibitors, friction modifiers, lube oil flow improvers, dispersants, anti-foamants, anti-wear agents, detergents, metal rust inhibitors and seal swellants.

Viscosity modifiers impart high and low temperature operability to the lubricating oil and also exhibit acceptable viscosity or fluidity at low temperatures.

V.I. improvers are generally high molecular weight hydrocarbon polymers or more preferably polyesters. The V.I. improvers may also be derivatized to include other properties or functions, such as the addition of dispersancy properties.

These oil soluble V.I. polymers will generally have number average molecular weights of from $10^3$ to $10^6$, preferably $10^4$ to $10^6$, e.g. 20,000 to 250,000, as determined by gel permeation chromatography or membrane osmometry.

Examples of suitable hydrocarbon polymers include homopolymers and copolymers of two or more monomers of $C_2$ to $C_{30}$, e.g. $C_2$ to $C_8$ olefins, including both alpha-olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha- olefins, atactic polypropylene, hydrogenated polymers and copolymers and terpolymers of styrene, e.g. with isoprene and/or butadiene.

More specifically, other hydrocarbon polymers suitable as viscosity index improvers in the present invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, alpha-olefins or lower alkenes, e.g., $C_3$ to $C_{18}$ alpha-olefins or lower alkenes. The conjugated dienes include isoprene, butadiene, 2,3-dimethylbutadiene, piperylene and/or mixtures thereof, such as isoprene and butadiene. The monovinyl aromatic compounds include vinyl di- or polyaromatic compounds, e.g., vinyl naphthalene, or mixtures of vinyl mono-, di- and/or polyaromatic compounds, but are preferably monovinyl monoaromatic compounds, such as styrene or alkylated styrenes substituted at the alpha-carbon atoms of the styrene, such as alpha-methylstyrene, or at ring carbons, such as o-, m-, p-methylstyrene, ethylstyrene, propylstyrene, isopropylstyrene, butylstyrene isobutylstyrene, tert-butylstyrene (e.g., p-tert-butylstyrene). Also included are vinylxylenes, methylethylstyrenes and ethylvinylstyrenes. Alpha-olfins and lower alkenes optionally included in these random, tapered and block copolymers preferably include ethylene, propylene, butene, ethylene-propylene copolymers, isobutylene, and polymers and copolymers thereof. As is also known in the art, these random, tapered and block copolymers may include relatively small amounts, that is less than about 5 mole %, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to said nucleus, the arms being comprised of homopolymer or interpolymer of said conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621, 3,318,813, 3,630,905, 3,668,125, 3,763,044, 3,795,615, 3,835,053, 3,838,049, 3,965,019, 4,358,565, and 4,557,849, the disclosures of which are herein incorporated by reference.

The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794, 4,160,739, 4,137,185, or copolymers of ethylene and propylene reacted or grafted with nitrogen compounds such as shown in U.S. Pat. Nos. 4,068,056, 4,068,058, 4,146,489 and 4,149,984.

Suitable hydrocarbon polymers are ethylene copolymers containing from 15 to 90 wt. % ethylene, preferably 30 to 80 wt. % of ethylene and 10 to 85 wt. % , preferably 20 to 70 wt. % of one or more $C_3$ to $C_{28}$, preferably $C_3$to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1,4,4-dimethyl-1-pentene, and 6-methyl-heptene-1, etc., and mixtures thereof.

Terpolymers, tetrapolymers, etc., of ethylene, said $C_{3-28}$ alpha-olefin, and non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The preferred V.I. improvers are polyesters, most preferably polyesters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g. see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers to impart dispersancy include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methyl-vinyl) pyrrolidone, N-vinyl-5-methyl pyrrolidone, N-vinyl-3,3-dimethylpyrrolidone, N-vinyl-5-ethyl pyrrolidone, etc.

Corrosion inhibitors, also known as anti-corrosive agents, reduce the degradation of the non-ferrous metallic parts in contact with the fluid. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioether, and also preferably in the presence of carbon dioxide. As discussed hereinabove, the phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorous for ½ to 15 hours, at a temperature in the range of 150° to 400° F. Neutralization of the phosphosulfurized hydrocarbon may be effected in the manner taught in U.S. Pat. No. 2,969,324.

Other suitable corrosion inhibitors include copper corrosion inhibitors comprising hydrocarbyl-thio-disubstituted derivatives of 1, 3, 4-thiadiazole, e.g., $C_2$ to $C_{30}$; alkyl, aryl, cycloalkyl, aralkyl and alkaryl-mono-, di-, tri-, or tetra- or thio- disubstituted derivatives thereof.

Representative examples of such materials included 2,5-bis(octylthio) 1,3,4-thiadiazole; 2,5-bis(octyldithio)-

1,3,4-thiadiazole; 2,5-bis(octyltrithio)-1,3,4-thiadiazole; 2,5-bis(octyltetrathio)-1,3,4-thiadiazole; 2,5-bis(nonylthio)-1,3,4-thiadiazole; 2,5-bis(dodecyldithio)-1,3,4-thiadiazole; 2-dodecyldithio-5-phenyldithio-1,3,4- thiadiazole; 2,5-bis(cyclohexyl dithio)-1,3,4-thiadiazole; and mixtures thereof.

Preferred copper corrosion inhibitors are the derivative of -1,3,4-thiadiazoles such as those described in U.S. Pat. Nos. 2,719,125, 2,719,126, and 3,087,932; especially preferred is the compound 2,5-bis(t-octyldithio)-1,3,4-thiadiazole commercially available as Amoco 150, and 2,5-bis(t-nonyldithio)-1,3,4-thiadiazole, commercially available as Amoco 158.

The preparation of such materials is further described in U.S. Pat. Nos. 2,719,125, 2,719,126, 3,087,932, and 4,410,436, the disclosures of which are hereby incorporated by reference.

Oxidation inhibitors reduce the tendency of mineral oils to deteriorate in service which deterioration is evidenced by the products of oxidation such as sludge and varnish-like deposits on the metal surfaces and by an increase in viscosity. Such oxidation inhibitors include alkaline earth metal salts of alkylphenol thioethers having preferably $C_5$ to $C_{12}$ alkyl side chains, e.g. calcium nonylphenol sulfide, barium t-octylphenol sulfide; aryl amines, e.g. dioctylphenylamine, phenyl-alpha-naphthylamine; phosphosulfurized or sulfurized hydrocarbons, etc.

Friction modifiers serve to impart the proper friction characteristics to an ATF as required by the transmission manufacturer and it will be appreciated that the herein described additives of the invention are intended to be used at least as the primary friction modifier, if not the sole friction modifier.

Representative examples of suitable friction modifiers which may be used in conjunction with the additives of this invention are found, for example, in U.S. Pat. No. 3,933,659, which discloses fatty acid esters, amides, and N-fatty diethanolamines; U.S. Pat. No. 4,176,074, which describes molybdenum complexes of polyisobutenyl succinic anhydride-amino alkanols; U.S. Pat. No. 4,105,571, which discloses glycerol esters of dimerized fatty acids; U.S. Pat. No. 3,779,928, which discloses alkane phosphonic acid salts; U.S. Pat. No. 3,778,928, which discloses alkane phosphonic acid salts; U.S. Pat. No. 3,778,375, which discloses reaction products of a phosphonate with an oleamide; U.S. Pat. No. 3,852,205, which discloses S-carboxy-alkylene hydrocarbyl succinamic acid and mixtures thereof; U.S. Pat. No. 3,879,306, which discloses N-(hydroxy-alkyl)alkenyl succinamic acids or succinimides; U.S. Pat. No. 3,932,290, which discloses reaction products of di-(lower alkyl) phosphites and epoxides; and U.S. Pat. No. 4,028,258, which discloses the alkylene oxide adduct of phosphosulfurized N-(hydroxyalkyl) alkenyl succinimides; all for use as friction modifiers in automatic transmission fluids. The disclosures of the above patents are herein incorporated by reference.

As stated hereinabove, it is an important advantage of the present invention that supplemental friction modifying agents do not have to be employed and, in fact, can be excluded from the compositions of this invention.

Dispersants maintain oil insolubles, resulting from oxidation during use, in suspension in the fluid thus preventing sludge flocculation and precipitation. Suitable dispersants include, for example, dispersants of the ash-producing or ashless type, the latter type being preferred.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g. polyisobutene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is know. Examples of compounds useful as the promoter include phenolic substance such as phenol, naphthol, alkylphenol, thiophenol, sulfurized alkylphenol, and condensation products of formaldehyde with a phenolic substance; alcohols such as methanol, 2-propanol, octyl alcohol, cellosolve, ethylene glycol, stearyl alcohol, and cyclohexyl alcohol; and amines such as aniline, phenylenediamine, phenyl-beta-naphthylamine, and dodecylamine. A particularly effective method for preparing the basic salts comprises mixing an acid with an excess of a basic alkaline earth metal neutralizing agent and a least one alcohol promoter, and carbonating the mixture at an elevated temperature such as 60°–200° C. This class of materials is discussed further hereinabove in connection with detergents and metal rust inhibitors.

The most preferred ash-producing detergents include the metal salts of sulfonic acids, alkyl phenols, sulfurized alkyl phenols, alkyl salicylates, naphthenates and other oil soluble mono- and dicarboxylic acids. Highly basic (viz, overbased) metal salts, such as highly basic alkaline earth metal sulfonates (especially Ca and Mg salts) are frequently used as detergents. They are usually produced by heating a mixture comprising an oil-soluble sulfonate or alkaryl sulfonic acid, with an excess of alkaline earth metal compound above that required for complete neutralization of any sulfonic acid present, and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as for example haloparaffins, olefins that may be obtained by dehydrogenation of paraffins, polyolefins as for example polymers from ethylene, propylene, etc. The alkaryl sulfonates usually contain from about 9 to about 70 more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to about 220%, although it is preferred to use at least 125%, of the stoichiometric amount of metal required for complete neutralization.

Various other preparations of basic alkaline earth metal alkaryl sulfonates are known, such as those described in U.S. Pat. Nos. 3,150,088 and 3,150,089, wherein overbasing is accomplished by hydrolysis of an alkoxide-carbonate complex with the alkaryl sulfonate in a hydrocarbon solvent/diluent oil.

Ashless dispersants, which are the preferred dispersant for use in connection with this invention, are so called despite the fact that, depending on their constitution, the dispersant may upon combustion yield a nonvolatile material such as boric oxide or phosphorus pentoxide; however, they ordinarily do not contain metal and therefore do not yield a metal-containing ash on combustion. Many types of ashless dispersants are known in the art, and any of them are suitable for use in the lubricant compositions of this invention. The following are illustrative:

1. Reaction products of carboxylic acids (or derivatives thereof) containing at least about 30 and preferably at least about 50 carbon atoms with nitrogen containing compounds such as amine, organic hydroxy compounds such as phenols and alcohols, and/or basic inorganic materials. Examples of these "carboxylic dispersants" are described, for example, in British Patent No. 1,306,529 and in U.S. Pat. Nos. 3,272,746, 3,341,542, 3,454,607 and 4,654,403.

More, specifically, nitrogen- or ester-containing ashless dispersants comprise members selected from the group consisting of oil soluble salts, amides, imides, oxazolines and esters, or mixtures thereof, of long chain hydrocarbyl-substituted mono- and dicarboxylic acids or anhydride or ester derivatives thereof wherein said long chain hydrocarbyl group is a polymer, typically of a $C_2$ to $C_{10}$, e.g., $C_2$ to $C_5$, monoolefin, said polymer having a number average molecular weight of from about 700 to 5000.

The long chain hydrocarbyl-substituted dicarboxylic acid material which can be used to make the dispersant includes the reaction product of long chain hydrocarbon polymer, generally a polyolefin, with (i) monounsaturated $C_4$ to $C_{10}$ dicarboxylic acid wherein (a) the carboxyl groups are vicinyl, (i.e. located on adjacent carbon atoms) and (b) at least one, preferably both, of said adjacent carbon atoms are part of said mono unsaturation; or with (ii) derivatives of (i) such as anhydrides or $C_1$to $C_5$ alcohol derived mono- or diesters of (i). Upon reaction with the hydrocarbon polymer, the monounsaturation of the dicarboxylic acid material becomes saturated. Thus, for example, maleic anhydride becomes a hydrocarbyl-substituted succinic anhydride.

Typically, from about 0.7 to about 4.0 (e.g., 0.8 to 2.6), preferably from about 1.0 to about 2.0, and most preferably from about 1.1 to about 1.7 moles of said unsaturated $C_4$ to $C_{10}$ dicarboxylic acid material are charged to the reactor per mole of polyolefin charged.

Normally, not all of the polyolefin reacts with the unsaturated acid or derivative and the hydrocarbyl-substituted dicarboxylic acid material will contain unreacted polyolefin. The unreacted polyolefin is typically not removed from the reaction mixture (because such removal is difficult and would be commercially infeasible) and the product mixture, stripped of any unreacted monounsaturated $C_4$ to $C_{10}$ dicarboxylic acid material, is employed for further reaction with the amine or alcohol as described hereinafter to make the dispersant.

Characterization of the average number of moles of dicarboxylic acid, anhydride or ester which have reacted per mole of polyolefin charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged using techniques well known in the art. Functionality is defined solely with reference to the resulting product mixture. Consequently, although the amount of said reacted polyolefin contained in the resulting product mixture can be subsequently modified, i.e., increased or decreased by techniques known in the art, such modifications do not alter functionality as defined above. The term hydrocarbyl-substituted dicarboxylic acid material is intended to refer to the product mixture whether it has undergone such modification or not.

Accordingly, the functionality of the hydrocarbyl-substituted dicarboxylic acid material will be typically at least about 0.5, preferably at least about 0.8, and most preferably at least about 0.9, and can vary typically from about 0.5 to about 2.8 (e.g., 0.6 to 2), preferably from about 0.8 to about 1.4, and most preferably from about 0.9 to about 1.3.

Exemplary of such unsaturated mono and dicarboxylic acids, or anhydrides and esters thereof are fumaric acid, itaconic acid, maleic acid, maleic anhydride, chloromaleic acid, chloromaleic anhydride, acrylic acid, methacrylic acid, crotonic acid, cinnamic acid, etc.

Preferred olefin polymers for reaction with the unsaturated dicarboxylic acids or derivatives thereof are polymers comprising a major molar amount of $C_2$ to $C_{10}$, e.g., $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene: or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the dispersants will usually have number average molecular weights within the range of about 700 and about 5,000, more usually between about 800 and about 3000. Particularly useful olefin polymers have number average molecular weights within the range of about 900 and about 2500 with approximately one terminal double bond per polymer chain. An especially useful starting material for highly potent dispersant additives is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography" John Wiley and Sons New York, 1979.

Processes for reacting the olefin polymer with the $C_{4-10}$ unsaturated dicarboxylic acid, anhydride or ester are known in the art. For example, the olefin polymer and the dicarboxylic acid or derivative may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8 wt. %, preferably 3 to 7 wt. % chlorine, or bromine, based on the weight of polymer, by passing the chlorine or bromine through the polyolefin at a temperature of 60° to 250° C., e.g. 120° to 160° C., for about 0.5 to 10, preferably 1 to 7 hours. The halogenated polymer may then be reacted with sufficient unsaturated acid or derivative at 100° to 250° C., usually about 180° to 235° C., for about 0.5 to 10, e.g. 3 to 8 hours, so the product obtained will contain the desired number of moles of the unsaturated acid or derivative per mole of the halogenated polymer. Processes of this general type are taught in U.S. Pat. Nos. 3,087,936, 3,172,892, 3,272,746 and others.

Alternatively, the olefin polymer, and the unsaturated acid or derivative are mixed and heated while adding chlorine to the hot material. Processes of this type are disclosed in U.S. Pat. Nos. 3,215,707, 3,231,587, 3,912,764, 4,110,349, and in U.K. 1,440,219.

By the use of halogen, about 65 to 95 wt. % of the polyolefin, e.g. polyisobutylene will normally react with the dicarboxylic acid or derivative. Upon carrying out a thermal reaction without the use of halogen or a catalyst, then usually only about 50 to 75 wt. % of the polyisobutylene will react. Chlorination helps increase the reactivity.

At least one hydrocarbyl-substituted dicarboxylic acid material is mixed with at least one of amine, alcohol, including polyol, aminoalcohol, etc., to form the dispersant additives. When the acid material is further reacted, e.g., neutralized, then generally a major proportion of at least 50 percent of the acid producing units up to all the acid units will be reacted.

Amine compounds useful as nucleophilic reactants for neutralization of the hydrocarbyl-substituted dicarboxylic acid materials include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxyl amines with 1 to 6 hydroxy groups, preferably 1 to 3 hydroxy groups are particularly useful. Preferred amines are aliphatic saturated amines, including those of the general formulas:

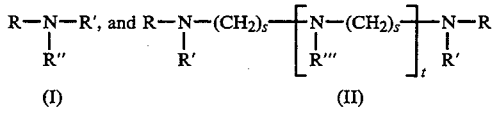

(I) (II)

wherein R, R′, R″ and R‴ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R‴ can additionally comprise a moiety of the formula:

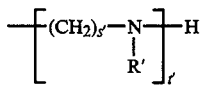

(III)

wherein R′ is as defined above, and wherein s and s′ can be the same or a different number of from 2 to 6, preferably 2 to 4; and t and t′ can be the same or different and are numbers of from 0 to 10, preferably 2 to 7, and most preferably about 3 to 7, with the proviso that the sum of t and t′ is not greater than 15. To assure a facile reaction, it is preferred that R, R′, R″, R‴, s, s′, t and t′ be selected in a manner sufficient to provide the compounds of formulas II and III with typically at least one primary or secondary amine group, preferably at least two primary or secondary amine groups. This can be achieved by selecting at least one of said R, R′, R″ or R‴ groups to be hydrogen or by letting t in formula III be at least one when R‴ is H or when the IV moiety possesses a secondary amino group. The most preferred amine of the above formulas are represented by formula III and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene) triamine; N,N-dimethyl-1,3-diaminopropane; N,N-di-(2-aminoethyl) ethylene diamine; N,N-di(2-hydroxyethyl)-1,3-propylene diamine; 3-dodecyloxypropylamine; N-dodecyl-1,3-propane diamine; trishydroxymethylaminomethane (THAM); diisopropanol amine; diethanoi amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula (V):

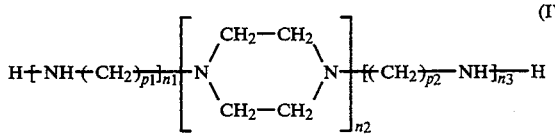

(IV)

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc. Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulas:

$$NH_2\text{-alkylene}\left(\text{o-alkylene}\right)_m NH_2 \qquad \text{(XXIX)}$$

where m has a value of about 3 to 70 and preferably 10 to 35; and $$R\left[\text{alkylene}\left(\text{o-alkylene}\right)_n NH_2\right]_a \qquad \text{(XV)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a" which is a number of from 3 to 6. The alkylene groups in either formula XXIX or XV may be straight or branched chains containing about 2 to 7, and preferably about 2 to 4 carbon atoms.

The polyoxyalkylene polyamines of formulas XXIX or XV above, preferably polyoxyalkylene diamines and polyoxyalkylene triamines, may have average molecular weights ranging from about 200 to about 4000, and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D- 2000, T-403", etc.

The amine is readily reacted with the selected hydrocarbyl-substituted dicarboxylic acid material, e.g. alkenyl succinic anhydride, by heating an oil solution containing 5 to 95 wt. % of said hydrocarbyl-substituted dicarboxylic acid material to about 100° to 250° C., preferably 125 to 175° C., generally for 1 to 10, e.g. 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition, having a functionality of 1.6, derived from reaction of polyolefin and maleic anhydride; i.e., preferably the pentamine is used in an amount sufficient to provide about 0.4 equivalents (that is, 1.6 divided by $(0.8\times5)$ equivalents) of succinic anhydride units per reactive nitrogen equivalent of the amine.

The ashless dispersant esters are derived from reaction of the aforesaid long chain hydrocarbyl-substituted dicarboxylic acid material and hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, monooleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether alcohols and amino alcohols including, for example, the oxyalkylene-, oxy-arylene-, aminoalkylene-, and aminoarylene-substituted alcohols having one or more oxyalkylene, oxyarylene, aminoalkylene or aminoarylene radicals. They are exemplified by Cellosolve, Carbitol, N,N,N',N'-tetrahydroxy-trimethylene diamine, and ether alcohols having up to about 150 oxyalkylene radicals in which the alkylene radical contains from 1 to about 8 carbon atoms.

The ester dispersant may be diesters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. Nos. 3,381,022 and 3,836,471.

Hydroxy amines which can be reacted with the aforesaid long chain hydrocarbyl-substituted dicarboxylic acid materials to form dispersants include 2-amino-1-butanol, 2-amino-2-methyl-1-propanol, p-(beta-hydroxy-ethyl)-aniline, 2-amino-1-propanol, 3-amino-1-propanol, 2-amino-2-methyl-1,3-propanediol, 2-amino-2- ethyl-1,3-propanediol, N-(beta-hydroxy-propyl)-N'-(beta-amino-ethyl)-piperazine, tris(hydroxymethyl) aminomethane (also known as trismethylolaminomethane), 2-amino-1-butanol, ethanolamine, beta-(beta-hydroxyethoxy)- ethylamine, and the like. Mixtures of these or similar amines can also be employed. The above description of nucleophilic reactants suitable for reaction with the hydrocarbyl-substituted dicarboxylic acid material includes amines, alcohols, and compounds of mixed amine and hydroxy containing reactive functional groups, i.e., amino-alcohols.

A preferred group of ashless dispersants are those derived from polyisobutylene substituted with succinic anhydride groups and reacted with said polyethylene amines, e.g. tetraethylene pentamine, pentaethylene hexamine, polyoxyethylene and polyoxypropylene amines, e.g. polyoxypropylene diamine, trismethylolaminomethane, or said above-described alcohols such as pentaerythritol, and combinations thereof. One class of particularly preferred dispersants includes those derived from polyisobutene substituted with succinic anhydride groups and reacted with (i) a hydroxy compound, e.g. pentaerythritol, (ii) a polyoxyalkylene polyamine, e.g. polyoxypropylene diamine, and/or (iii) a polyalkylene polyamine, e.g. polyethylene diamine or tetraethylene pentamine referred to herein as PIBSA-TEPA. Another preferred dispersant class includes those derived from polyisobutenyl succinic anhydride reacted with (i) a polyalkylene polyamine, e.g. tetraethylene pentamine, and/or (ii) a polyhydric alcohol or polyhydroxy-substituted aliphatic primary amine, e.g. pentaerythritol or trismethylolaminomethane.

2. Reaction products of relatively high molecular weight aliphatic or alicyclic halides with amines, preferably polyalkylene polyamines. These may be characterized as "amine dispersants" and examples thereof are described for example, in the U.S. Pat. Nos. 3,275,554, 3,454,555 and 3,565,804.

3. Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Patents are illustrative:

U.S. Pat. No. 3,725,277
U.S. Pat. No. 3,725,480
U.S. Pat. No. 3,726,882
U.S. Pat. No. 3,980,569

4. Products obtained by post-treating the carboxylic, amine or Mannich dispersants with such reagents as urea, thiourea, carbon disulfide, phosphosulfurized hydrocarbons, aldehydes, ketones, carboxylic acids, hydrocarbon-substituted succinic anhydrides, nitriles, epoxides, boron compounds, phosphorus compounds or the like. Exemplary materials of this type are described in the following U.S. Patents:

U.S. Pat. No. 2,805,217
U.S. Pat. No. 3,087,936
U.S. Pat. No. 3,254,025
U.S. Pat. No. 3,394,179
U.S. Pat. No. 3,511,780
U.S. Pat. No. 3,703,536
U.S. Pat. No. 3,704,308
U.S. Pat. No. 3,708,422
U.S. Pat. No. 3,850,822
U.S. Pat. No. 4,113,639
U.S. Pat. No. 4,116,876

More specifically, the nitrogen and ester containing dispersants preferably are further treated by boration as generally taught in U.S. Pat. Nos. 3,087,936 and 3,254,025 (incorporated herein by reference). This is readily accomplished by treating the selected nitrogen dispersant with a boron compound selected from the class consisting of boron oxide, boron halides, boron acids and esters of boron acids in an amount to provide from about 0.1 atomic proportion of boron for each mole of said nitrogen dispersant to about 20 atomic proportions of boron for each atomic proportion of nitrogen of said nitrogen dispersant. Usefully borated dispersants contain from about 0.05 to 2.0 wt. %, e.g. 0.05 to 0.7 wt. % boron based on the total weight of said borated nitrogen dispersant. The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said nitrogen dispersant) of said boron compound, preferably boric acid which is most usually added as a slurry to said nitrogen dispersant and heating with stirring at from about 135° to 190° C., e.g. 140°-170° C., for from 1 to 5 hours followed by nitrogen stripping at said temperature ranges. Or, the boron treatment can be carried out by adding boric acid to the hot reaction mixture of the dicarboxylic acid material and amine while removing water.

Post-treatment with phosphosulfurized hydrocarbons may be obtained by post-reacting the above described reaction product of polyamine and hydrocarbyl-substituted dicarboxylic acid material with a phospho-sulfurized hydrocarbon, for example, by mixing the reactants together and heating the mixture for from 1 to 6 hours, or more usually from 2 to 5 hours at a temperature in the range of from about 100° F., to about 400° F., e.g. 100° to 250° F., or more generally from about 150° F. to about 225° F. The reaction may by aided by blowing a stream of inert gas through the mixture during the heating period.

The phosphosulfurized hydrocarbons may be prepared by reaction of sulfide of phosphorus such as $P_2S_3$, $P_2S_5$, $P_4S_7$, $P_4S_{10}$, preferably $P_2S_5$, with a suitable hydrocarbon material such as a heavy petroleum fraction, a polyolefin, or a terpene such as alpha-pinene or beta-pinene.

The phosphosulfurized hydrocarbon can be prepared by reacting the hydrocarbon with from about 5 to 30 wt. percent of a sulfide of phosphorus, preferably with from about 10 to 20 wt. percent of phosphorous pentasulfide under anhydrous conditions at temperatures of from about 150° to about 600° F. for from about one-half to about 15 hours. The preparation of the phosphosulfurized hydrocarbons are well known in the art and are described, for example, in U.S. Pat. Nos. 2,875,188, 3,511,780, 2,316,078, 2,805,217 and 3,850,822, the disclosures of which are incorporated herein by reference. The preparation of the phosphosulfurized reaction products is described for example, in Ser. No. 211,428, filed on Jun. 24, 1988 by Ryer and Watts. Said application is assigned to the assignee of this invention and the disclosure thereof is incorporated herein by reference.

5. Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Patents:

U.S. Pat. No. 3,329,658
U.S. Pat. No. 3,519,565
U.S. Pat. No. 3,666,730
U.S. Pat. No. 3,702,300

All of the above-noted patents are incorporated by reference herein for their disclosures of ashless dispersants.

Lubricating oil flow improvers (LOFI) include all those additives which modify the size, number, and growth of wax crystals in lube oils in such a way as to impart improved low temperature handling, pumpability, and/or vehicle operability as measured by such tests as pour point and mini rotary viscometry (MRV). The majority of lubricating oil flow improvers are polymers or contain polymers. These polymers are generally of two types, either backbone or sidechain.

The backbone variety, such as the ethylene-vinyl acetates (EVA), have various lengths of methylene segments randomly distributed in the backbone of the polymer, which associate or cocrystallize with the wax crystals inhibiting further crystal growth due to branches and noncrystalizable segments in the polymer.

The sidechain type polymers, which are the predominant variety used as LOFI's, have methylene segments as the side chains, preferably as straight side chains. These polymers work similarly to the backbone type except the side chains have been found more effective in treating isoparaffins as well as n-paraffins found in lube oils. Representative of this type of polymer are $C_8$–$C_{18}$ dialkylfumarate/vinyl acetate copolymers, polyacrylates, polymethacrylates, and esterified styrene- maleic anhydride copolymers.

Foam control can be provided by an anti-foamant of the polysiloxane type, e.g. silicone oil and polydimethyl siloxane.

Anti-wear agents, as their name implies, reduce wear of moving metallic parts. Representative of conventional anti-wear agents which may be used to include, for example, the zinc dialkyl dithiophosphates, and the zinc diaryl dithiophosphates. Suitable anti-wear agents also comprise the phosphorous- and sulfur-containing product mixtures described in copending application Ser. No. 210,831 filed on Jun. 24, 1988 by Ryer and Gutierrez and the Continuation-in-Part thereof: Ser. No. 370,315, filed Jun. 22, 1989. Said applications are assigned to the assignee of this invention, and the disclosures thereof are incorporated herein by reference.

In a preferred embodiment of the phosphorous- and sulfur-containing product mixtures disclosed in said commonly assigned applications, the following three components, namely: (1) organic phosphite ester, (2) hydrocarbyl thioalkanol, and (3) heterodialkanol are reacted in admixture, preferably in simultaneous admixture.

The organic phosphite ester reactant is characterized by at least one of the formulas:

$$P(OR_{10})_3 \qquad \text{(XXIX')}$$

$$H-\overset{\overset{\displaystyle O}{\|}}{P}-(OR_{10})_2 \qquad \text{(XXIX'')}$$

wherein $R_{10}$, independently, represents the same or different $C_1$–$C_5$, preferably $C_2$ to about $C_4$, saturated or unsaturated, straight or branched chain (preferably straight chain) hydrocarbyl radical or the aromatic radical:

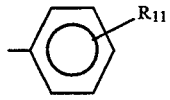

(XXX)

wherein $R_{11}$ represents H or $C_1$–$C_4$ alkyl.

Representative examples of suitable $R_{10}$ groups include methyl, ethyl, n-propyl, i-propyl, n-butyl, i-butyl, t-butyl, n-butenyl, n-propenyl, phenyl, p-methylphenyl, p-propylphenyl, o-butylphenyl and p-butylphenyl.

The more preferred $R_{10}$ groups include ethyl, n-propyl, n-butyl and phenyl. Although not required, it is preferred that the $R_{10}$ groups are the same for any given organic phosphite ester. The most preferred phosphite esters are dibutyl phosphite or tributyl phosphite. The methods for preparing the organic phosphite ester reactant are known in the art and are discussed, for example, in U.S. Pat. No. 3,513,093, the disclosure of which is incorporated herein by reference.

The hydrocarbyl thioalkanol reactant is characterized by at least one of the following formulas:

$$R_{12}-S-\underset{\underset{\displaystyle R_{14}}{|}}{(R_{13}O)_n}H \qquad \text{XXXI}$$

$$R_{15}-S-R_{16}-OH \qquad \text{XXXII}$$

wherein $R_{12}$ and $R_{15}$ represent a saturated or unsaturated, straight or branched chain hydrocarbyl radical having at most two unsaturated linkages, (preferably straight chain alkyl) typically about $C_8$–$C_{30}$, preferably about $C_8$–$C_{20}$, and most preferably about $C_{10}$–$C_{14}$ alkyl; $R_{13}$ represents a $C_2$–$C_3$ alkanetriyl radical, preferably $C_2$ alkanetriyl; $R_{14}$ represents H (most preferred) or a saturated or unsaturated, straight or branched chain hydrocarbyl radical (preferably straight chain alkyl), typically about $C_1$–$C_{18}$, preferably $C_1$–$C_{14}$, and most preferably $C_1$–$C_{12}$ alkyl; $R_{16}$ represents a saturated or unsaturated, straight or branched chain hydrocarbyl radical, (preferably straight chain alkylene), typically $C_2$–$C_{30}$, preferably $C_2$–$C_{20}$, and most preferably $C_2$–$C_{16}$ alkylene; and n represents a number from 1 to about 6, preferably 1 to about 3. Typically, n is 1 when $R_{13}$ is $C_3$ alkanetriyl and can vary from 1 to about 6 when $R_{13}$ is $C_2$ alkanetriyl.

Representative examples of suitable compounds falling within the scope of the above structural formulas XXXI and XXXII are shown below in Tables 1 and 2, in chart form, wherein each of the variable groups in associated with specific compounds.

TABLE 1

Formula $R_{12}-S-\underset{\underset{\displaystyle R_{14}}{|}}{(R_{13}O)_n}H$ (XXXI)

| $R_{12}$ | $R_{13}$ | $R_{14}$ | n |
|---|---|---|---|
| $C_8H_{16}-$ | $-CH_2-CH-$ | $CH_3-$ | 1 |
| $C_{10}H_{20}-$ | $-CH_2-CH-CH_2-$ | $C_2H_5-$ | 1 |
| $C_{12}H_{24}-$ | $-CH_2-CH-$ | $H-$ | 1 |
| $C_{14}H_{28}-$ | $-CH_2-CH-$ | $C_2H_5-$ | 2 |
| $C_{15}H_{30}-$ | $-CH_2-CH-$ | $C_3H_7-$ | 3 |
| $C_{20}H_{40}-$ | $-CH_2-CH-$ | $C_6H_{13}-$ | 3 |
| $C_{25}H_{50}-$ | $-CH_2-CH-$ | $C_{12}H_{25}-$ | 1 |
| $C_{30}H_{60}-$ | $-CH_2-CH-CH_2-$ | $C_{18}H_{37}-$ | 1 |

TABLE 2

| Formula $R_{15}$—S—$R_{16}$—OH (XXVII) | |
|---|---|
| $R_{15}$ | $R_{16}$ |
| $C_8H_{16}$— | —$C_2H_4$— |
| $C_{10}H_{20}$— | —$C_3H_6$— |
| $C_{12}H_{24}$— | —$C_4H_8$— |
| $C_{14}H_{28}$— | —$C_{10}H_{20}$— |
| $C_{15}H_{30}$— | —$C_{10}H_{20}$— |
| $C_{20}H_{40}$— | —$C_2H_4$— |
| $C_{25}H_{50}$— | —$C_5H_{10}$— |
| $C_{30}H_{60}$— | —$C_{10}H_{20}$— |

The heterodialkanol reactant is characterized by the formula:

(XXXIII)

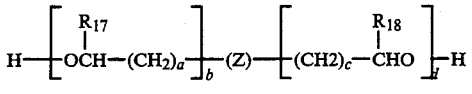

where $R_{17}$ and $R_{18}$ each independently can represent hydrogen, and alkyl $C_1$ to about $C_{12}$ alkyl (preferably straight chain alkyl), preferably $C_1$ to about $C_6$ alkyl, and most preferably $C_1$ to about $C_3$ alkyl; Z is a linking group selected from —S—, —S—S—, —O—, and >NR', wherein R' is hydrogen, $C_1$–$C_4$ alkyl, preferably $C_1$ to about $C_3$ alkyl, and monohydroxy-substituted alkyl, preferably a terminal monohydroxy-substituted alkyl, the alkyl being as described above in connection with $R_{17}$ and $R_{18}$; a, b, c, and d each independently represent numbers which can vary from 1 to about 3, preferably 1 or 2. Preferably, $R_{17}$ and $R_{18}$ are the same, the numbers represented by b and d are the same, as are the numbers represented by a and c, thereby resulting in a bisalkanol.

When Z is —O—, formula XXXII can represent ethylene glycol and derivatives thereof; when Z is >NR', and R' is alkyl or hydrogen, formula XXXIII can represent a diethanolamine and derivatives thereof; when R' is a monohydroxy-substituted alkyl, such as —$(CH_2)_2$—OH, formula XXXIII can represent triethanolamine and derivatives thereof.

If b or d are greater than 1, then formula XXXIII is meant to express alkoxylated derivatives of the heterodialkanols, such as ethoxylated derivatives.

The preferred heterodialkanols are thiodialkanols, wherein in formula XXXIII, Z is —S—, and $R_{17}$ and $R_{18}$ are, independently, hydrogen, ethyl or methyl.

In the most preferred thiodialkanols of formula XXXIII, a, b, c and d are each 1 or 2, x is 1, $R_{17}$ is hydrogen or methyl, $R_{18}$ is hydrogen, methyl or ethyl, and Z is sulfur.

Representative thiodialkanols include 2,2'-thiodiethanoi; 3,3'-thiodipropanol; thio-bis ethoxy-ethanol; thiobisisopropoxyisopropanol; and mixtures thereof.

In selecting the appropriate thioalkanol and heterodialkenol, it is desirable to ensure that at least one member thereof possesses at least one —$SCH_2CH_2OH$ group. In the preferred embodiment, the reaction of the organic phosphite ester, the hydrocarbyl thioalkanol and the heterodialkanol is performed, for example, by mixing at least one member from each of the three components and heating the reaction mixture under reflux conditions at a reaction temperature of typically from about 80° to about 150° C., (e.g. 80° to about 125° C.) preferably from about 90° to about 125° C., (e.g. 90° to 120° C.), and most preferably from about 100° to about 115° C. for a period of time of typically from about 1 to about 10, preferably from about 2 to about 8, and most preferably from about 4 to about 6 hours.

A convenient way to determine completion of the reaction is to periodically monitor the reaction mixture by removing samples therefrom and subjecting the samples to infrared analysis. As the reaction proceeds, a hydrogen phosphite peak will appear (at 4.1 microns on the IR spectra) and its height will continue to grow over the course of the reaction. At the same time, the height of the hydroxyl peak (at 2.9 microns on the IR spectra) attributable to alcohol by-product heterodialkanol, and hydrocarbyl thioalkanol will diminish. Accordingly, at some point in time during the reaction, the height of the hydrogen phosphite peak will exceed the height of the hydroxyl peak.

The reaction is terminated at any time after this point, and preferably before the point at which the hydroxyl peak disappears altogether. If the reaction is continued beyond the point at which the hydroxyl peak disappears, phase separations can occur.

The reaction product mixture can be stripped of low molecular weight alcohols, typically derived from the phosphite reactant, for safety reasons related to the flash point of such alcohols. In addition, the presence of low molecular weight alcohol in the product mixture typically results in eventual evaporation of the alcohol over time. This can induce phase separation, which in certain instances may not be desired, e.g., if one wants to use the entire product mixture. To avoid this occurrence, or to homogenize the two phases after separation, it is advantageous to replace the stripped alcohol with a higher molecular weight alcohol (e.g., $C_8$ to $C_{20}$ alcohol), such as tridecylalcohol. However, the addition of the higher molecular weight alcohol preferably should not be conducted until the product mixture has cooled to below reaction temperature and typically is conducted at temperatures of from 20° to about 40° C. Otherwise, the higher molecular weight alcohol addition can induce product rearrangement which may not be desirable.

Typically, the higher molecular weight alcohol is added to achieve a weight ratio of Product:Alcohol of from about 80:20 to about 95:5, preferably 90:10.

If phase separation occurs, the lower phase typically contains hydrocarbyl phosphites and phosphorous acid and the upper phase typically contains predominantly non-phosphorous thio and oxy containing ethers. While a two phase mixture can be employed as such, it is preferred to homogenize the phases with, for example, a suitable cosolvent such as tridecyl alcohol as described above.

The reaction may be performed with or without a catalyst, however, it is preferable to perform the reaction in the presence of a basic catalyst such as sodium methoxide to decrease the reaction time. Other suitable basic catalysts which may be employed include, for example, sodium phenate, tertiary amines such as triethyl amine or pyridine, and metal carbonates such as potassium carbonate, sodium carbonate or magnesium carbonate.

In a preferred embodiment, the mole ratio of the components (I) (organic phosphite ester), (II) (hydrocarbyl thioalkanol), and (III) (heterodialkanol) in the reaction mixture is controlled to be typically about 1:0.6–1.4:0.8–1.4, preferably about 1:0.8–1.2:0.9–1.2, and most preferably about 1:0.9–1.1:0.9–1.1. Most preferably, equal molar ratio of all three components are employed.

In a less preferred embodiment, the reactive components can be added and mixed sequentially, provided that the mixing is complete prior to attaining the reaction temperatures specified above.

The above mixed reaction products may be used as such. However, the products may be sulfurized to form the corresponding thiophosphates. Such sulfurization may be carried out by heating the product in the presence of sulfur and a basic catalyst such as a tertiary amine, e.g., triethyl amine. This type of sulfurization reaction is well known and is discussed, for example, in Kosolapov, Organic Phosphorous Compounds, Vol. 5, page 53 (1973).

Seal swellants include mineral oils of the type that provoke swelling, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g., dihexyl phthalate, as are described in U.S. Pat. No. 3,974,081.

Some of these numerous additives can provide a multiplicity of effects e.g., a dispersant oxidation inhibitor. This approach is well known and need not be further elaborated herein.

Compositions, when containing these additives, typically are blended into the base oil in amounts which are effective to provide their normal attendant function. Representative effective amounts of such additives are illustrated as follows:

| Compositions | (Broad) wt % | (Preferred) wt % |
|---|---|---|
| V.I. Improver | 1–12 | 1–4 |
| Corrosion Inhibitor | 0.01–3 | 0.01–1.5 |
| Oxidation inhibitor | 0.01–5 | 0.01–1.5 |
| Dispersant | 0.1–10 | 0.1–5 |
| Lube Oil Flow Improver | 0.01–2 | 0.01–1.5 |
| Detergents and Rust Inhibitors | 0.01–6 | 0.01–3 |
| Anti-Foaming Agents | 0.001–0.1 | 0.001–0.01 |
| Anti-wear Agents | 0.001–5 | 0.001–1.5 |
| Seal Swellant | 0.1–8 | 0.1–4 |
| Friction Modifiers | 0.01–3 | 0.01–1.5 |
| Lubricating Base Oil | Balance | Balance |

In broad sense therefore, the friction modifiers of the present invention, when employed in a lubricating oil composition, typically in a minor amount, are effective to impart at least enhanced friction modification properties thereto, relative to the same composition in the absence of the present additives. Additional conventional additives, particularly dispersants and anti-wear additives selected to meet the particular requirements of a selected type of lubricating oil composition, also can be included as desired.

Accordingly, for embodiment 1 which employs Component-1 alone, while any effective friction modifying amount of the Component-1 amide can be incorporated into a lubricating oil composition, it is contemplated that such effective amount be sufficient to provide a given composition with an amount of the additive of typically from about 0.001 to about 0.5, preferably from about 0.01 to about 0.4, and most preferably from about 0.05 to about 0.3 wt. % based on the weight of said composition.

For embodiment 2, which employs a mixture of Component-1 and Component-2, while any effective friction modifying amount of said mixture may be employed in a lubricating oil composition, it is contemplated that such effective amount will vary typically from about 0.01 to about 3, preferably from about 0.02 to about 1.5, and most preferably from about 0.03 to about 0.6 (e.g., 0.2 to about 0.4) wt. %, based on the weight of the composition. The above amounts refer to the weight % of the combination of Component-1 and -2. The weight ratios of each component in the mixture are described above.

For embodiment 3, while any effective friction modifying amount of the salt additive can be incorporated into a lubricating oil composition, it is contemplated that such effective amount be sufficient to provide a given composition with an amount of the additive of typically from about 0.01 to about 3 preferably from about 0.02 to about 1.5, and most preferably from about 0.03 to about 0.6 wt. %, based on the weight of said composition.

When other additives are employed, it may be desirable, although not necessary, to prepare additive concentrates comprising concentrated solutions or dispersions of the additive composition of the present invention together with the other additives (said concentrate additive mixture being referred to herein as an additive package) whereby the several additives can be added simultaneously to the base oil to form the lubricating oil compositions. Dissolution of the additive concentrate into the lubricating oil may be facilitated by solvents and by mixing accompanied with mild heating, but this is not essential. The concentrate or additive package will typically be formulated to contain the friction modifier additive of this invention and optional additional additives in proper amounts to provide the desired concentration in the final formulation when the additive package is combined with a predetermined amount of base lubricant. Thus, the additive can be added to small amounts of base oil or, optionally, to other compatible solvents, along with other desirable additives to form concentrates containing active ingredients in collective amounts of typically from about 25 to about 100, and preferably from about 65 to about 95, and most preferably from about 75 to about 90 wt. % additives in the appropriate proportions, with the remainder being base oil.

The final formulation may employ typically about 10 wt. % of the additive package with the remainder being base oil.

As noted above, the amide additives of Component-1 contemplated for use in this invention are characterized as possessing good friction modifying properties. This has the added benefit of permitting the use of low amounts thereof to achieve the overall desired friction modification. Typically, as the amount of friction modifer is increased in an ATF, the lower the breakaway static torque becomes. As the breakaway static torque (as well as the breakaway static coefficient of friction) decreases, the bands and clutches of the automatic transmission become increasingly more susceptible to slipage. Consequently, it is extremely advantageous to be able to control, e.g., reduce, the amount of friction modifier without sacrificing the friction modifying properties of the fluid, e.g., as measured by the torque ratio $T_O/T_D$ or torque differential $T_O$-$T_D$ and stability thereof, since this facilitates the simultaneous achievement of both the desired breakaway static torque and other friction characteristics. It has also been found that the use of an ashless dispersant such as a borated or unborated carboxylic dispersant or a borated or unborated phosphorous- and sulfur-containing reaction product mixture dispersant additive, results in a lubricating oil that possesses excellent friction durability and reduced corrosivity relative to an additive combination that does not inlcude the ashless dispersant.

Further improvements in friction stability can be attained by inclusion of Component-2 with Component-1 without significant attendant adverse influence on the low temperature viscosity properties and break-in period of the fluid.

All of said weight percents expressed herein are based on active ingredient (a.i.) content of the additive, and/or upon the total weight of any additive package, or formulation which will be the sum of the a.i. weight of each additive plus the weight of total oil or diluent.

Thus, use of the present friction modifiers additives permit the formulator to flexibly tailor an ATF in order to achieve the balance of properties required under today's more stringent transmission manufacturers' specifications.

The following examples are given as specific illustrations of the claimed invention. It should be understood, however, that the invention is not limited to the specific details set forth in the examples. All parts and percentages in the examples as well as in the remainder of the specification and claims are by weight unless otherwise specified.

EXAMPLE 1

Part A

A polyisobutenyl succinic anhydride (PIBSA) having a succinic anhydride (SA) polyisobutylene (PIB) ratio (SA:PIB) i.e. functionality, of 1.04 was prepared by heating a mixture of 100 parts of polyisobutylene (PIB) having an Mn of 940 with 13 parts of maleic anhydride to a temperature of about 220° C. When the temperature reached 120° C., chlorine addition was begun and 1.05 parts of chlorine at a constant rate were added to the hot mixture for about 5 hours. The reaction mixture was then heat soaked at 220° C. for about 1.5 hours and then stripped with nitrogen for about 1 hour. The resulting polyisobutenyl succinic anhydride had an ASTM Saponification Number of 112 which calculates to a succinic anhydride (SA) to polyisobutylene (PIB) ratio (functionality) of 1.04 based upon the starting PIB as follows:

$$\text{SA:PIB ratio } \frac{\text{SAP} \times \text{Mn}}{112200 - (96 \times \text{SAP})} = \frac{112 \times 940}{112200 - (96 \times 112)} = 1.04$$

The PIBSA product was 90 wt. % active ingredient (a.i.), the remainder being primarily unreacted PIB. The SA:PIB ratio of 1.04 is based upon the total PIB charged to the reactor as starting material, i.e., both the PIB which reacts and the PIB which remains unreacted.

Part B

The PIBSA of Part A was aminated as follows: 1500 grams (1.5 moles) of the PIBSA and 1666 grams of S150N lubricating oil (solvent neutral oil having a viscosity of about 150 SSU at 100° C.) were mixed in a reaction flask and heated to about 149° C. Then, 193 grams (1 mole) of a commercial grade of polyethyleneamine which was a mixture of polyethyleneamines averaging about 5 to 7 nitrogen per molecule hereinafter referred to as, PAM, was added and the mixture was heated to 150° C. for about 2 hours; followed by 0.5 hours of nitrogen stripping, then cooling to give the final product (PIBSA-PAM). This product had a viscosity of 140 cs. at 100° C., a nitrogen content of 2.12 wt. % and contained approximately 50 wt. % PIBSA-PAM and 50 wt. % unreacted PIB and mineral oil (S150N).

Part C

A phosphosulfurized olefin was prepared by reacting 4.9 parts by weight of alpha-pinene with 1 part by weight of phosphorous pentasulfide for about 5 hours at temperatures in the range of 180° to 250° C. During the reaction the mixture was stirred and blown with nitrogen to eliminate the hydrogen sulfide that was evolved. The resulting phosphosulfurized olefin analyzed about 5 wt. percent of phosphorus and about 13 wt. percent of sulfur. Its viscosity at 210° F. was about 27 CST. For convenience in handling in subsequent reactions, the product was diluted with a S15ON mineral oil to form a 65 wt. percent concentrate.

Part D

A phosphosulfurized PIBSA-PAM dispersant was prepared by reacting 18 parts by weight of the PIBSA-PAM reaction product formed in Part B with 6 parts by weight of the phosphosulfurized alpha-pinene formed in Part C at a temperature in the range of 100° to 130° C. about 2 hours, after which the reaction was purged with nitrogen at about 120° C. for an additional hour. The resulting product had an active ingredient concentration of about 52% with the remainder being unreacted PIB and diluent oil.

EXAMPLE 2

A reaction product of isostearic acid (ISA) and tetraethylene pentamine (TEPA; Union Carbides HP TEPA) was prepared by adding 450 grams of isostearic acid to a 500 ml round bottom 4-neck flask equipped with a reflux condenser, a stirring bar and a nitrogen bubbler in order to obtain a level sufficient to permit agitation and heat transfer. The flask contents were then heated to 110° C. and 189 grams (about 1 mole) of TEPA were added slowly with mixing. After all of the TEPA was added to the flask, an additional 450 grams of ISA were added with stirring at 110° C. (a total of about 3.125 moles of ISA were added). The batch temperature was then raised slowly to drive the condensation reaction. Water of condensation began to appear immediately and was removed through the flask overhead system with a nitrogen sparge. After most of this water was removed (approximately 160° C.), vacuum stripping was applied and the flask temperature was raised to 200° C. to drive the condensation to completion. The reaction was complete after about 5 hours with 3 moles of isostearic acid (ISA) reacting with 1 mole of tetraethylene pentamine (TEPA) to form ISA-TEPA. The resulting product is designated friction modifier-1 (FM-1).

TEPA, theoretically, is a single polyamine compound having the formula $H_2N—N—N—N—NH_2$, where —N—N— represents

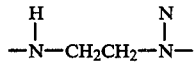

However, commercially available TEPA, such as Union Carbide's HP TEPA, actually comprises a mixture of amines. The actual composition of the TEPA which is commercially available from Union Carbide is as follows:

| Polyamine Structure | Union Carbide Technical Grade TEPA, wt. % | Union Carbide HP TEPA, wt. % |
|---|---|---|
| N—N—N | 13.6 | 2.0 |
| 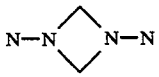 | 2.8 | 0.6 |
| 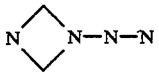 | 9.4 | 3.5 |
| 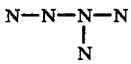 | 12.6 | 13.5 |
| N—N—N—N—N | 22.4 | 28.7 |
| 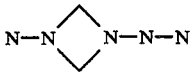 | 14.5 | 19.7 |
| 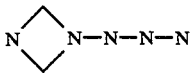 | 6.9 | 11.8 |
| 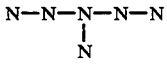 | 2.4 | 3.4 |
| 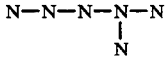 | 3.8 | 3.4 |
| N—N—N—N—N—N | 2.4 | 2.6 |
| Unidentified higher molecular weight species | 9.2 | 10.8 |

EXAMPLE 3

An ATF base fluid, designated hereinafter as the Test Base was formulated with conventional amounts of seal swell additive anti-oxidant, viscosity index improver and mineral oil base.

To a sample of the Test Base there were added 3.9 wt. % of the phosphosulfurized PIBSA-PAM dispersant prepared in accordance with EXAMPLE 1, Part D, together with 0.2 wt. % of the ISA-TEPA friction modifier of EXAMPLE 2. The resulting formulation is designated as Formulation 1.

To another sample of the Test Base there were added 3.9% of the phosphosulfurized PIBSA-PAM of EXAMPLE 1, Part D, together with 0.2% of the commercially available friction modifier octadecenyl succinic acid (OSA). The resulting formulation is designated Comparative Formulation 2C.

The compositions of Formulations 1 and 2C are summarized in Table 3 as follows:

TABLE 3

| Component, wt. | Formulation Number 1 | 2C |
|---|---|---|
| phosphosulfurized PIBSA-PAM | 3.9 | 3.9 |
| ISA-TEPA | 0.2 | — |
| octadecenyl succinic acid (OSA) | — | 0.2 |
| Test Base | 94.9 | 95.9 |

The Formulations 1 and 2C were then tested in accordance with a modified SAE No. 2 Friction Test.

THE MODIFIED SAE NO. 2 FRICTION TEST

This test, referred to herein as Test Procedure 1, uses SAE No. 2 type friction machine operated successfully for 1000 cycles wherein no unusual clutch plate wear or composition-faceplate flaking occurs. The test is conducted, at 100° C., in a continuous series of 20 second cycles, each cycle consisting of three phases as follows: Phase I (10 seconds)—motor on at speed of 3,600 rpm, clutch plates disengaged; Phase II (5 seconds)—motor off, clutch plates engaged; and Phase III (5 seconds)—motor off, clutch plate released. 1000 cycles are repeated using 11,600 ft./lbs. (if flywheel torque at 40 psig of applied clutch pressure. During the clutch engagement, friction torque is recorded as a function of time as the motor speed declines from 3600 rpm to 0. From the torque traces, the dynamic torque ($T_D$) in determined midway between the start and end of clutch engagement (i.e., at a motor speed of 1800 rpm), as well as the torque at 200 rpm ($T_{200}$). The amount of time in seconds in phase II it takes for the motor speed to go from 3600 to 0 rpm is referred to an the lock-up time. The torque ratio of the oil formulation is then determined from ($T_{200}/T_D$) as is the torque difference ($T_{200}/T_D$). In addition to determining midpoint dynamic torque ($T_D$) and torque at 200 rpm ($T_{200}$), the breakaway static torque is also determined. This is achieved essentially as described in connection with Test Procedure 2, except that clutch engagement is performed 3 seconds after completion of the dynamic torque cycle regardless of the temperature of the fluid. $T_S$ is recorded as described in connection with Test Procedure 2. Moreover, the predetermined cycle frequency at which static torque measurements made can differ from Test Procedure 2.

The breakaway static torque ratio expresses the ability of the transmission to resist slippage; the lower the ratio, the higher the slippage.

The test results for Formulations I and 2C are shown in Table 6, Runs 1 and 2, The data reported in Table 6 is derived from the 1000th cycle.

A commercially acceptable range for $T_{200}$-$T_D$ in the test procedure 2 is from about 0.9 to about 1.0. Values lower than 0.9 can result in slipping clutches and values increasingly higher than. 1.0 cause increasingly harsher shifts. Accordingly, as can be seen in Table 6, the ratio of $T_{200}/T_D$ for comparative Formulation 2C is higher than acceptable. At 0.99, the ratio of $T_{200}/T_D$ for Formulation 1 falls within the acceptable range. With respect to the parameter $T_{200}$-$T_D$, also known as delta torque, values in the zero to −10 nm range give commercially acceptably smooth shift performance. As can be seen in Table 6, Comparative Formulation 2C is characterized by a delta torque of +9.9 which would result in very harsh shift performance, whereas Formulation 1 is characterized by a delta -torque well within the acceptable range. Similar considerations apply to the breakaway static torque ratio.

The data in Table 6 thus demonstrates the superiority of an ATF formulation which utilizes ISA-TEPA as a friction modifier over a similar ATF formulation which utilizes a commercial friction modifier in place of the ISA-TEPA of the invention.

EXAMPLE 4

A PIBSA-PAM was prepared in accordance with the procedure of EXAMPLE 1, Part B, except that a mole ratio of PIBSA:PAM of 2.2:1 was used. The resulting PIBSA-PAM was borated by mixing 98 parts by weight of the PIBSA-PAM with 2 parts by weight of boric acid. The mixture was heated to 160° C. while stirring and blowing the reaction mass with nitrogen. The mixture was kept at 160° C. for 2 hours, sparged with nitrogen for 1 hour and filtered. The resulting product was analyzed for 0.35 boron.

To another sample of the Test. Base there were added 4.5 wt. % of the borated PIBSA-PAM dispersant of Example 4, 0.5 wt. % of triphenyl phosphite (TPP) and 0.2 wt. % of the same ISA-TEPA friction modifier that was used in Formulation 1. The resulting formulation is designated Formulation 3.

To another sample of the Test Base there were added 4.5 wt. % of the borated PIBSA-PAM dispersant of EXAMPLE 4, 0.5 wt. % of triphenyl phosphite and 0.2 wt. % of a hydroxy ether amine friction modifier having the formula:

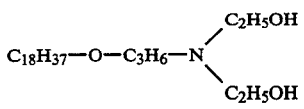

The hydroxy ether amine friction modifier was prepared by first reacting 270 parts by weight of octadecenyl alcohol with 53 parts by weight of acrylonitrile in the presence of an acid or basic catalyst at a temperature in the range of 20°–600° C. for about 6 hours to form an ether nitrile intermediate. The intermediate was then hydrogenated in the presence of a Raney nickel catalyst at a temperature in the range of from 25° to 40° C. for about 2 hours to form an ether amine. The ether amine was then reacted with 44 parts by weight of ethylene oxide in the presence of a base catalyst at a temperature in the range of 20° to about 40° C. for 2 hours to form the hydroxy either amine product. The resulting formulation is designated. Comparative Formulation 4C.

The compositions of Formulations 2 and 4C are summarized in Table 4, as follows:

TABLE 4

| Component, wt. % | Formulation Number 3 | 4C |
|---|---|---|
| borated PIBSA-PAM | 4.5 | 4.5 |
| TPP | 0.5 | 0.5 |
| ISA-TEPA | 0.2 | — |
| hydroxy ether amine | — | 0.2 |
| Test Base | 94.8 | 94.8 |

The formulations 3 and 4C were then tested in accordance with the following 4000 cycle friction test.

4000 CYCLE FRICTION TEST

This test referred to herein as Test Procedure 2, uses a SAE No. 2 type friction machine operated successfully for 4000 cycles wherein no unusual clutch plate wear or composition-face plate flaring occurs. The test is conducted in a continuous series of 20 second cycles, each cycle consisting of three phases as follows: Phase I (10 seconds)—motor on at speed of 3,600 rpm, clutch plates disengaged; Phase II (5 seconds)—motor off—, clutch plates engaged; and Phase III (5 seconds)—motor off, clutch plates released. 4000 cycles are repeated using 20,740 J. of flywheel energy at 40 psi. of applied clutch pressure. During the clutch engagement, friction torque is recorded an a function of time as the motor speed declines from 3600 rpm to 0. From the torque traces, the dynamic torque ($T_D$) is determined midway between the start and end of clutch engagement (i.e., at a motor speed of 1800 rpm), as well as the torque ($T_0$) just before lock-up, e.g., between 20 and 0 rpm. The amount of time in seconds in Phase II it takes for the motor speed to go from 3600 to 0 rpm in referred to as the lock-up time. The torque ratio of the oil formulation is then determined from ($T_O/T_D$). In addition to determining midpoint dynamic torque ($T_D$) and static torque ($T_O$) the breakaway static torque is also determined. Breakaway static torque is determined at completion of certain predetermined cycles in the dynamic torque evaluation cycle sequence. Thus, after the flywheel returns to 0 rpm, it is accelerated to 1 rpm and maintained thereat. When the fluid temperature reaches 116° C., the flywheel, moving at 1 rpm, is engaged with the clutch pack, without releasing the clutch (i.e., clutch is not allowed to rotate) under a load of 40 psi. The torque is then measured as a function of time during which time slippage of the flywheel occurs. Two torque values are recorded. The first torque value ($T_{SMAX}$) is the highest torque observed during the test interval. For hard fluids, this typically occurs immediately upon clutch engagement and appears as an initial peak in the breakaway static torque curve. For softer fluids, slippage can occur almost immediately and no initial peak may be observed. The second torque value recorded ($T_S$) is the average of the torque values obtained during the 4 second interval from clutch engagement. Upon completion of the $T_S$ and $T_{SMAX}$ determination, a new dynamic torque cycle is begun as described above.

The breakaway static torque and $T_S/T_D$ ratio express the ability of the transmission to resist slippage; the lower the ratio, the higher the slippage.

The following is a summary of the 4000 cycle friction test conditions:

| | |
|---|---|
| Cycle Rate: | 3 per minute |
| Cycle Make-up: | Motor on, clutch released 10 sec<br>Motor off, clutch applied 5 sec<br>Motor off, clutch released 5 sec |
| Temperature: | 115 +/− 5° C. |
| Pressure: | 275 +/− 3 kPa |
| Velocity: | 3600 rpm |
| Energy: | 20740 +/1 100 J |
| Fluid Quantity: | 305 mL +/− 5 mL |
| Paper Speed: | 100 mm per sec |
| Torque Calibration | 2700 Nm |
| Total Cycles: | 4000 |

The test results for Formulations 3 and 4C are shown in Table 6, Runs 3 to 6. The data reported in Table 6 was measured after 200 and 4000 cycles of operation.

For test procedure 2, representative commercially acceptable ranges for various parameters illustrated at Table 6 are as follows:

$T_D$=120–150

$T_S$=90–130

$T_O/T_D$=0.90–1.0

$\Delta T_S$=Change in $T_S$ between 200 and 4000 cycles and reflects friction durability. Range is less than or equal to 40.

Lock-up=0.8–1.0

As can be seen from Table 6, both Formulations 3 and 4C resulted in $T_S$,$T_D$ and $T_O/T_D$ values which are acceptable after both 200 cycles and 4000 cycles. However, by comparing the 200 cycle data with the 4000 cycle data, it can be seen that Formulation 3 is characterized by higher friction stability than is Formulation 4C. By this comparison it can be seen that for Formulation 3, which uses the ISA-TEPA as a friction modifier, there was no measurable change in $T_O/T_D$ from the 200th to the 4000th cycle, whereas there was a slight change of 0.06 units (6.2%) in $T_O/T_D$ for Formulation 4C. Similarly, while there was a slight change of 0.01 units (1.3%) in $T_S/T_D$ for Formulation 3, there was a change of 15 units (17.4%) in $T_S/T_D$for Formulation 4C. The data thus demonstrates that an ATF formulation which utilizes ISA-TEPA as the friction modifying additive has excellent friction retention and meets all acceptable parameter limits as shown.

EXAMPLE 5

A phosphorous- and sulfur-containing reaction product mixture was prepared by adding to a 500 ml round bottom 4-neck flask equipped with a reflux condenser, a stirring bar and a nitrogen bubbler 250 grams of tributyl phosphite (9 mole %), 246 grams of hydroxyethyl-n-dodecyl sulfide, 122 grams of thiobisethanol, and 0.05 grams of sodium methoxide. The reaction flask was sealed and flushed with nitrogen, and the contents thereof was heated to 100° C. The reaction temperature was maintained at 115° C. for a total of 10 hours, during which time approximately 180 ml of butanol were recovered as overhead and infrared analysis indicated a product rearrangement such that the 4.1 u hydrogen phosphite peak exceeded the hydroxyl peak, which hydroxyl peak had not yet fully disappeared. The resulting reaction product was found to contain 5.8 wt. % phosphorous and 11.7 wt. % sulfur and existed as a single phase mixture and designated Anti-Wear Additive-1 (i.e., AW-1).

To a sample of the Test Base there were added 4.5 wt. % of the borated PIBSA-PAM dispersant of EXAMPLE 4, together with 0.5 wt. % of AW-1 containing reaction product of EXAMPLE 5 and 0.16 wt % of the ISA-TEPA of EXAMPLE 2 The resulting formulation is designated Formulation 5.

To another sample of the Test Base there were added 4.5 wt. % of the same borated PIBSA-PAM dispersant and 0.5 wt. % of the same phosphorous- and sulfur-containing reaction product that were used in Formulation 5. The resulting formulation is designated Comparative Formulation 6C.

The compositions of Formulations 5 and 6C are summarized in Table 5.

TABLE 5

| Component, wt. % | Formulation Number 5 | 6C |
|---|---|---|
| borated PIBSA-PAM | 4.5 | 4.5 |
| phosphorous- and sulfur- containing reaction product | 0.5 | 0.5 |

TABLE 5-continued

| Component, wt. % | Formulation Number 5 | 6C |
|---|---|---|
| ISA-TEPA | 0.16 | — |
| Test Base | 94.84 | 95.0 |

The Formulations 5 and 6C were then tested in accordance with the same modified SAE No. 2 Friction Test that was used to test Formulations I and 2C. The results of the test are tabulated in Table 6 as Runs 7 and 8.

The data in Table 6 shows that an ATF formulation which utilizes ISA-TEPA as a friction modifier (Formulation 5) will result in much smoother shifting characteristics than a similar ATF formulation (Formulation 6C) which does not contain any ISA-TEPA. This conclusion is based on the ratio of $T_{200}/T_D$for Formulation 6C being above the range of about 0.9 to 1.0, i.e. 1.07, and the delta torque for Formulation 6C being higher than the acceptable range of from zero to −10 n.m., i.e., +9.2. Both the ratio of $T_{200}/T_D$and the delta torque for Formulation 5 are in the acceptable range.

The data in Table 6 also illustrates that the presence of the ISA-TEPA friction modifier in Formulation 5 lowers the static breakaway torque relative to that of Formulation 6C which does not contain a friction modifying additive.

EXAMPLE 6

Part A

The diester reaction product of 2-octadecenyl succinic anhydride with 2,2'-thio-bis-ethanol was prepared by adding 0.5 mole of the alcohol to a mole of the anhydride at 120° C. The reaction mixture was stirred at this temperature until the anhydride carbonyl adsorption band is absent in the IR spectrum of the reaction mixture. This compound can be represented by the formula:

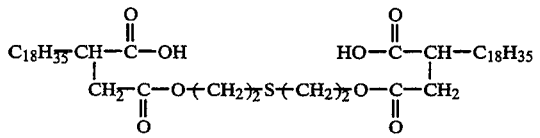

This above succinate ester Component-2 friction modifier additive is designated Friction Modifier-2 (FM-2).

Part B

The diester reaction product of 2-octadecenyl succinic anhydride with 2,2'-dithio-bis-ethanol was prepared by adding 0.5 mole of the alcohol to a mole of the anhydride at 120° C. The reaction mixture was stirred at this temperature until the anhydride carbonyl adsorption band is absent in the IR spectrum of the reaction mixture. This compound can be represented by the formula:

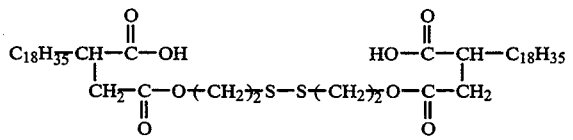

The above succinate ester Component-2 friction modifier additive is designated Friction Modifier-3 (FM-3).

Part C

To 0.1 parts by weight of FM-1 (ISA-TEPA) of Example 1, Part B was added 0.25 parts by weight of FM-2 of Example 6, Part A at room temperature. The resulting unreacted mixture is designated "Unreacted Friction Modifier Mixture-1" (i.e., URFMM-1).

Part D

To 0.1 parts by weight of FM-1 (ISA-TEPA) of Example 1 was added 0.25 parts by weight of FM-3 of Example 6 Part B at room temperature. The resulting unreacted mixture is designated URFMM-2.

Part E

A portion of each of the URFMM-1 and -2 samples was heated to 60° C. and maintained thereat for 0.75 hour while stirring. Each resultant product was a highly viscous fluid. The salt product derived from URFMM-1 is designated Friction Modifier Salt-1 (i.e., FMS-1); the salt product derived from URFMM-2 is designated FMS-2.

EXAMPLE 7

Several fully formulated automatic transmission fluids were prepared by preblending borated PIBSA-PAM dispersant of Example 4, Part B, a conventional oxidation inhibitor, seal swell agent, anti-wear additive AW-1, and selected friction modifiers, in oil at 70° C. while stirring for 1 hour. The preblend was then mixed with conventional viscosity index improver and further diluent oil.

The composition of the fully formulated automatic transmission fluid, minus friction modifiers, was held constant for Runs 9 to 24 and differed only by the friction modifiers present therein as summarized at Table 6.

The resulting formulations were tested as summarized at Table 6.

TABLE 6

FRICTION DATA

| Run No. | Formulation No. | Friction Modifier Type* | Friction Modifier W % | Anti-Wear Additive Type** | Anti-Wear Additive W % | Test Procedure No. | Test Cycle | $T_D$ (N.m) | $T_S$ (N.m) | $T_{SMAX}$ (N.m) | $T_0$ (N.m) |
|---|---|---|---|---|---|---|---|---|---|---|---|
| 1 | 1 | ISA-TEPA | 0.2 | None | 0 | 1 | 1000 | 136.2 | 107.4 | N/A | N/A |
| 2 | 2C | OSA | 0.2 | None | 0 | 1 | 1000 | 137.9 | 120.8 | N/A | N/A |
| 3 | 3 | ISA-TEPA | 0.2 | TPP | 0.5 | 2 | 200 | 127 | 96 | N/A | 125 |
| 4 | 3 | ISA-TEPA | 0.2 | TPP | 0.5 | 2 | 4000 | 142 | 106 | N/A | 139 |
| 5 | 4C | Hydroxy ether amine | 0.2 | TPP | 0.5 | 2 | 200 | 142 | 122 | N/A | 141 |
| 6 | 4C | Hydroxy ether amine | 0.2 | TPP | 0.5 | 2 | 4000 | 127 | 117 | N/A | 116 |
| 7 | 5 | ISA-TEPA | 0.16 | AW-1 | 0.5 | 1 | 1000 | 137.5 | 94.7 | N/A | N/A |
| 8 | 6C | None | 0 | AW-1 | 0.5 | 1 | 1000 | 133.8 | 109.7 | N/A | N/A |
| 9 | 7C | FM-2 | 0.25 | AW-1 | 0.62 | 2 | 200 | 128 | 117 | 117 | 133 |
| 10 | 7C | FM-2 | 0.25 | AW-1 | 0.62 | 2 | 4000 | 149 | 140 | 140 | 160 |
| 11 | 8 | FM-1 (ISA-TEPA) | 0.10 | AW-1 | 0.62 | 2 | 200 | 132 | 114 | 114 | 129 |
| 12 | 8 | FM-1 (ISA-TEPA) | 0.10 | AW-1 | 0.62 | 2 | 4000 | 156 | 138 | 138 | 166 |
| 13 | 9 | URFMM-1 | 0.35 | AW-1 | 0.62 | 2 | 200 | 128 | 103 | 104 | 122 |
| 14 | 9 | URFMM-1 | 0.35 | AW-1 | 0.62 | 2 | 4000 | 156 | 122 | 121 | 156 |
| 15 | 10 | FMS-1 | 0.35 | AW-1 | 0.62 | 2 | 200 | 128 | 104 | 105 | 126 |
| 16 | 10 | FMS-1 | 0.35 | AW-1 | 0.62 | 2 | 4000 | 153 | 119 | 121 | 153 |
| 17 | 11C | FM-3 | 0.25 | AW-1 | 0.62 | 2 | 200 | 129 | 128 | 128 | 140 |
| 18 | 11C | FM-3 | 0.25 | AW-1 | 0.62 | 2 | 4000 | 146 | 146 | 146 | 163 |
| 19 | 12 | URFMM-2 | 0.35 | AW-1 | 0.62 | 2 | 200 | 125 | 102 | 103 | 119 |
| 20 | 12 | URFMM-2 | 0.35 | AW-1 | 0.62 | 2 | 4000 | 149 | 122 | 122 | 156 |
| 21 | 13 | FMS-2 | 0.35 | AW-1 | 0.62 | 2 | 200 | 126 | 106 | 107 | 126 |
| 22 | 13 | FMS-2 | 0.35 | AW-1 | 0.62 | 2 | 4000 | 152 | 122 | 122 | 156 |
| 23 | 14C | None | 0 | AW-1 | 0.62 | 2 | 200 | 130 | 142 | 142 | 146 |
| 24 | 14C | None | 0 | AW-1 | 0.62 | 2 | 4000 | 156 | 167 | 165 | 179 |

| Run No. | $T_{200}$ (N.m) | $T_0/T_D$ | $T_{200}/T_D$ | $T_{200} - T_D$ | $T_S/T_D$ | $\Delta T_S$ | Lock-up |
|---|---|---|---|---|---|---|---|
| 1 | 135 | N/A | 0.99 | −1.2 | 0.79 | N/A | |
| 2 | 147.8 | N/A | 1.07 | +9.9 | 0.88 | N/A | |
| 3 | N/A | 0.98 | N/A | N/A | 0.76 | N/A | |
| 4 | N/A | 0.98 | N/A | N/A | 0.75 | 10 | |
| 5 | N/A | 0.99 | N/A | N/A | 0.86 | N/A | |
| 6 | N/A | 0.91 | N/A | N/A | 0.71 | 5 | |
| 7 | 135.5 | N/A | 0.97 | −4 | 0.69 | N/A | |
| 8 | 143 | N/A | 1.07 | +9.2 | 0.82 | N/A | |
| 9 | N/A | 1.04 | N/A | N/A | 0.91 | | .92 |
| 10 | N/A | 1.07 | N/A | N/A | 0.94 | 23 | 0.8 |
| 11 | N/A | 0.98 | N/A | N/A | 0.86 | N/A | 0.92 |
| 12 | N/A | 1.06 | N/A | N/A | 0.88 | 24 | .76 |
| 13 | N/A | 0.95 | N/A | N/A | 0.80 | N/A | 0.93 |
| 14 | N/A | 1.00 | N/A | N/A | 0.78 | 19 | 0.78 |
| 15 | N/A | .98 | N/A | N/A | 0.81 | N/A | 0.93 |
| 16 | N/A | 1.00 | N/A | N/A | 0.77 | 15 | 0.79 |
| 17 | N/A | 1.08 | N/A | N/A | 0.99 | N/A | 0.90 |
| 18 | N/A | 1.12 | N/A | N/A | 1.00 | 18 | 0.81 |
| 19 | N/A | 0.95 | N/A | N/A | .81 | N/A | 0.95 |
| 20 | N/A | 1.05 | N/A | N/A | .81 | 20 | 0.80 |

TABLE 6-continued

| FRICTION DATA | | | | | | | |
|---|---|---|---|---|---|---|---|
| 21 | N/A | 1.00 | N/A | N/A | .84 | N/A | 0.95 |
| 22 | N/A | 1.03 | N/A | N/A | .80 | 16 | 0.80 |
| 23 | N/A | 1.12 | N/A | N/A | 1.09 | N/A | 0.91 |
| 24 | N/A | 1.15 | N/A | N/A | 1.07 | 25 | 0.76 |

*FM-1 = ISA-TEPA
FM-2 = OSA reacted with thiobisethanol
FM-3 = OSA reacted with dithiobisethanol
URFMM-1 = mixture of FM-1 + FM-2 at W % A.I. of 0.1 and 0.25, respectively, in final formulation
URFMM-2 = mixture of FM-1 + FM-3 at W % A.I. of 0.1 and 0.25, respectively, in final formulation.
FMS-1 = URFMM-1 prereacted to form amine salt
FMS-2 = URFMM-2 prereacted for form amine salt
**AW-1 = reaction product of thiobisethanol, hydroxyethanol-dodecyl sulfide, and tributyl phosphite
TPP = triphenyl phosphite
N/A = not applicable As can be seen from Table 6, Run 10, FM-2 alone exhibits a $\Delta T_S$ of 23 versus 24 for FM-1 alone even though FM-2 is employed at more than twice the amount of FM-1. When the two are combined, however, the $\Delta T_S$ drops to between 15 and 19 for Runs 13 to 16.

Note further that while FM-3 alone exhibits a slightly better $\Delta T_S$ than URFMM-2, the other friction properties of URFMM-2 are substantially improved relative to FM-2 alone. FMS-2, on the other hand, gives better $\Delta T_S$ than either FM-2 alone or URFMM-2.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A lubricating oil composition adaptable for use as a power transmitting fluid, which comprises:

(a) lubricating oil; and (b) a friction modifying amount of the substantially imidazole free amide containing friction modifying condensation reaction product formed by condensation reacting, at a temperature of from about 120° to about 250° C., (1) at least one amine having from about 2 to about 60 total carbon atoms, at least 3 and up to about 15 nitrogen atoms, with at least one of said nitrogen atoms being present in the form of a primary amine group, and at least two of the remaining nitrogen atoms being present as primary or secondary amine groups, and (2 ) at least one fatty mono acid having from about 10 to about 30 carbon atoms; said condensation reaction being conducted with from about 2 to about 10 molar equivalents of fatty acid per mole of amine reactant and with water of condensation being removed from said reaction product; and said fatty acid being selected from straight chain saturated or branched chain saturated fatty acids, and mixtures thereof.

2. The lubricating oil compositions of claim 1, wherein said amine is an aliphatic saturated amine having one of the general formulas:

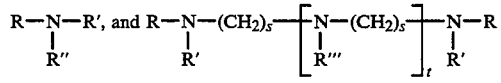

(I) (II)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

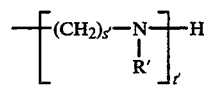

(III)

wherein R' is as defined above, wherein s and s' can be the same or a different number of from 2 to 6, wherein t and t' can be the same or different and are numbers of from 0 to 10, with the provisos that t is at least 1, that the sum of t and t' is not greater than 15, that the total number of nitrogen atoms in said amine is from 3 to about 15, and that the identity of R, R', R'' and R''' is selected to provide the requisite number of primary and secondary amino groups specified in claim 1.

3. The lubricating oil compositions of claim 1, wherein said amine is a mixture of poly(ethyleneamines) averaging about 5 to 7 nitrogen atoms per molecule.

4. The lubricating oil compositions of claim 1, wherein said amine is selected form the group consisting of diethylene triamine, triethylene tetramine, tetraethylene pentamine, di-(1,2-propylene)triamine, di-(1,3-propylene) triamine, and N,N-di-(2-aminoethyl) ethylene diamine and mixtures thereof.

5. The lubricating oil compositions of claim 1, wherein said amine comprises a heterocyclic nitrogen compounds having the general formula:

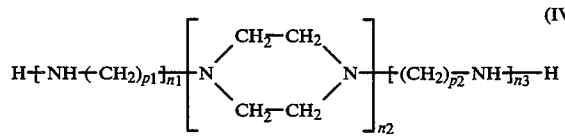

(IV)

wherein $p_1$ and $p_2$ are the same or different and are each integers of from 1 to 4, and $n_1$, $n_2$ and $n_3$ are the same or different and are each integers of from 1 to 3 with the proviso that the sum of $n_1$ and $n_3$ is at least 2.

6. The lubricating oil composition of claim 1, wherein said amine is a polyoxyalkylene polyamine having the formula:

$$R\left[\text{alkylene}\left(\text{o-alkylene}\right)_n NH_2\right]_x \quad \text{(XV)}$$

where n has a value of about 1 to 40 with the proviso that the sum of all the n's is from about 3 to about 70, and R is a polyvalent saturated hydrocarbon radical of up to ten carbon atoms wherein the number of substituents on the R group is represented by the value of x, which is a number of from 3 to 6.

7. The lubricating oil compositions of claim 1, wherein said amine is an amido-amine reaction product of at least one polyamine and an alpha, beta-unsaturated compound of the formula:

$$R^1-\overset{R^2}{\overset{|}{C}}=\overset{R^3}{\overset{|}{C}}-\overset{X}{\overset{\|}{C}}-Y \quad \text{(V)}$$

wherein X is sulfur or oxygen, Y is $-OR^4$, $-SR^4$, or $-NR^4(R^5)$, and $R^1$, $R^2$, $R^3$, $R^4$, and $R^5$ are the same or different and are hydrogen or substituted or unsubstituted $C_1$ to $C_{20}$ hydrocarbyl.

8. The lubricating oil composition of claim 1, wherein said amine is tetraethylene pentamine, and said fatty acid is isostearic acid.

9. An additive concentrate comprising a base oil in an amount up to about 75 wt. % and from about 25 to about 100 wt. % of said concentrate of a substantially imidazole free friction modifying reaction product formed by reacting, at a temperature of from about 120° to about 250° C., (1) at least one amine having from about 2 to about 60 total carbon atoms, from 3 to about 15 nitrogen atoms, at least one of said nitrogen atoms is present as a primary amine group and at least two remaining nitrogen atoms are present as primary or secondary amine groups, and (2) at least one fatty monoacid having from about 10 to about 30 carbon atoms; said reaction being conducted with from about two to about ten molar equivalents of fatty monoacid per mole of amine reactant; and said fatty monoacid being selected from straight chain saturated or branched chain saturated fatty acids and mixtures thereof.

10. A process for improving the friction modification of a lubricating oil adapted for use as a power transmitting fluid, which comprises admixing with said lubricating oil a friction modifying amount of an additive composition comprising:

(a) lubricating oil; and (b) a friction modifying amount of a substantially imidazole free amide containing reaction product formed by reacting, at a temperature of from about 120° to 250° C., (1) at least one amine having from about 2 to about 60 total carbon atoms, at least 3 and up to about 15 nitrogen atoms, with at least one of said nitrogen atoms being present in the form of a primary amine group, and at least two of the remaining nitrogen atoms being present as primary or secondary amine groups, and (2) at least one fatty mono acid having from about 10 to about 30 carbon atoms; said reaction being conducted with from about 2 to about 10 molar equivalents of fatty acid per mole of amine reactant; and said fatty acid being selected from straight chain saturated or branched chain saturated fatty acids, and mixtures thereof.

* * * * *